US009122200B2

(12) United States Patent
Saito et al.

(10) Patent No.: US 9,122,200 B2
(45) Date of Patent: Sep. 1, 2015

(54) IMAGE FORMING APPARATUS HAVING A REPLACEABLE MEMBER DETERMINATION UNIT

(75) Inventors: Yasuhide Saito, Kanagawa (JP); Ryotaro Nomi, Kanagawa (JP); Mamoru Sasamae, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 571 days.

(21) Appl. No.: 12/895,905

(22) Filed: Oct. 1, 2010

(65) Prior Publication Data

US 2011/0236038 A1 Sep. 29, 2011

(30) Foreign Application Priority Data

Mar. 24, 2010 (JP) ..... 2010-068445

(51) Int. Cl.
*G03G 15/00* (2006.01)
*G03G 15/08* (2006.01)

(52) U.S. Cl.
CPC ..... *G03G 15/0863* (2013.01); *G03G 15/0855* (2013.01); *G03G 15/0865* (2013.01); *G03G 2215/0697* (2013.01)

(58) Field of Classification Search
CPC ..... G03G 15/0863; G03G 15/0855
USPC ..... 399/12, 13
See application file for complete search history.

(56) References Cited

U.S. PATENT DOCUMENTS

| | | | | | |
|---|---|---|---|---|---|
| 4,967,234 | A * | 10/1990 | Tani et al. | ..... | 399/13 |
| 5,745,822 | A * | 4/1998 | Nishimura et al. | | |
| 6,029,018 | A * | 2/2000 | Rogers et al. | ..... | 399/12 |
| 2006/0159472 | A1 * | 7/2006 | Ushiroji et al. | | |
| 2008/0124095 | A1 * | 5/2008 | Wakide | ..... | 399/12 |
| 2009/0220250 | A1 * | 9/2009 | Funahashi | ..... | 399/12 |

FOREIGN PATENT DOCUMENTS

| | | | |
|---|---|---|---|
| JP | 09-114166 | A | 5/1997 |
| JP | 2001-272836 | A | 10/2001 |
| JP | 2004-309945 | A | 11/2004 |
| JP | 2008116630 | A * | 5/2008 |
| JP | 2008-129553 | A | 6/2008 |

OTHER PUBLICATIONS

Communication from the Japanese Patent Office dated Dec. 17, 2013, in a counterpart Japanese application No. 2010-068445.

* cited by examiner

*Primary Examiner* — Walter L Lindsay, Jr.
*Assistant Examiner* — Milton Gonzalez
(74) *Attorney, Agent, or Firm* — Sughrue Mion, PLLC

(57) ABSTRACT

An image forming apparatus includes a replaceable member, a first determination unit, and a second determination unit. The replaceable member is removable from the image forming apparatus in an open state of a door and has a storage portion storing given information. The first determination unit determines whether or not a response from the storage portion exists. The second determination unit determines the image forming apparatus is in the open state or a removed state where the replaceable member is removed from the image forming apparatus when the first determination unit determines the response is not exist in given number of times.

6 Claims, 24 Drawing Sheets

IMAGE FORMING APPARATUS HAVING A REPLACEABLE MEMBER DETERMINATION UNIT

CROSS-REFERENCE TO RELATED APPLICATIONS

This application is based upon and claims priority under 35 USC 119 from Japanese Patent Application No. 2010-068445, filed Mar. 24, 2010.

BACKGROUND

1. Technical Field

The present invention relates to an image forming apparatus.

2. Related Art

Conventional image forming apparatus are configured in such a manner that work of, for example, replacing or checking the mounting states of toner cartridges that contain toners and mounted inside the image forming apparatus main body is carried out by exposing the toner cartridges by opening a door that is provided in, for example, the front wall or a side wall of the image forming apparatus main body.

SUMMARY OF THE INVENTION

According to an aspect of the invention, an image forming apparatus includes a replaceable member, a first determination unit, and a second determination unit. The replaceable member is removable from the image forming apparatus in an open state of a door and has a storage portion storing given information. The first determination unit determines whether or not a response from the storage portion exists. The second determination unit determines the image forming apparatus is in the open state or a removed state where the replaceable member is removed from the image forming apparatus when the first determination unit determines the response is not exist in given number of times.

BRIEF DESCRIPTION OF THE DRAWINGS

Exemplary embodiments of the invention will be described in detail based on the following figures, wherein.

DETAILED DESCRIPTION

An exemplary embodiment of the present invention will be hereinafter described with reference to the drawings.

Figure 2:
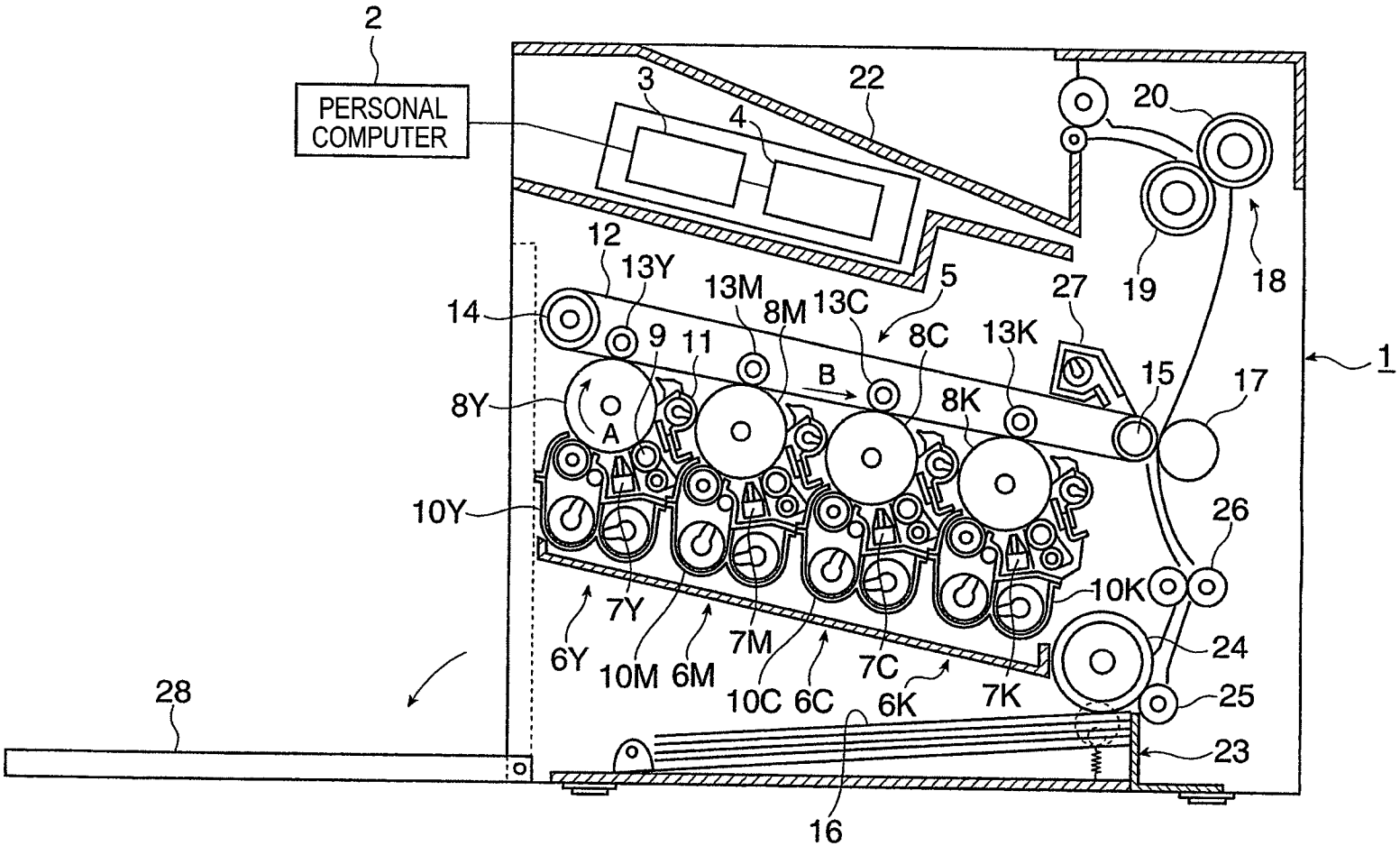
FIG. 2 shows the configuration of the tandem color printer according to the exemplary embodiment.
Figure 3:
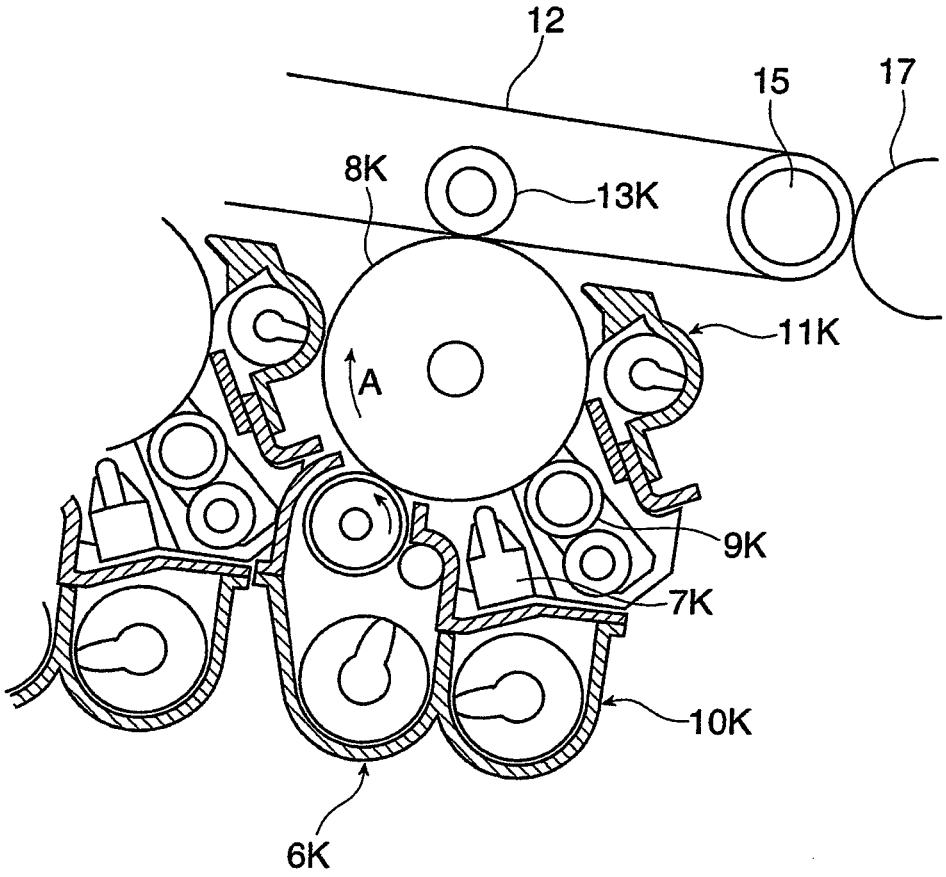
FIG. 3 shows the configuration of an image forming unit of the color printer according to the exemplary embodiment.

FIG. 2 shows the configuration of a tandem color printer which is an image forming apparatus according to the exemplary embodiment of the invention. FIG. 3 shows the configuration of an image forming unit of the color printer.

As shown in FIG. 2, the color printer outputs a full-color or monochrome image on the basis of image data that is output from a personal computer 2, an image reading device (not shown), or the like or transmitted over a telephone line, a LAN, or the like.

Figure 4:
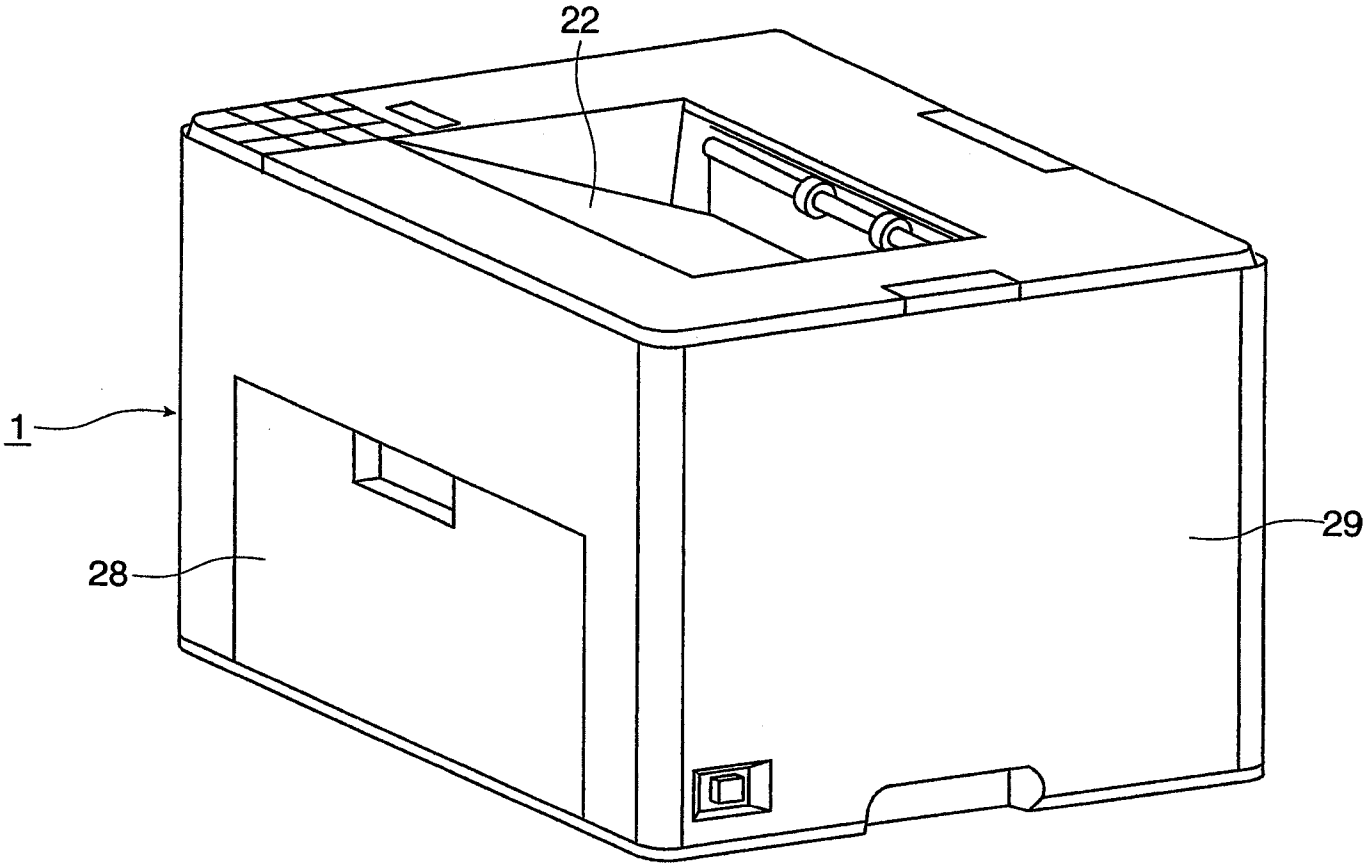
FIG. 4 is a perspective view showing a general appearance of a main body of the color printer according to the exemplary embodiment.
Figure 5:
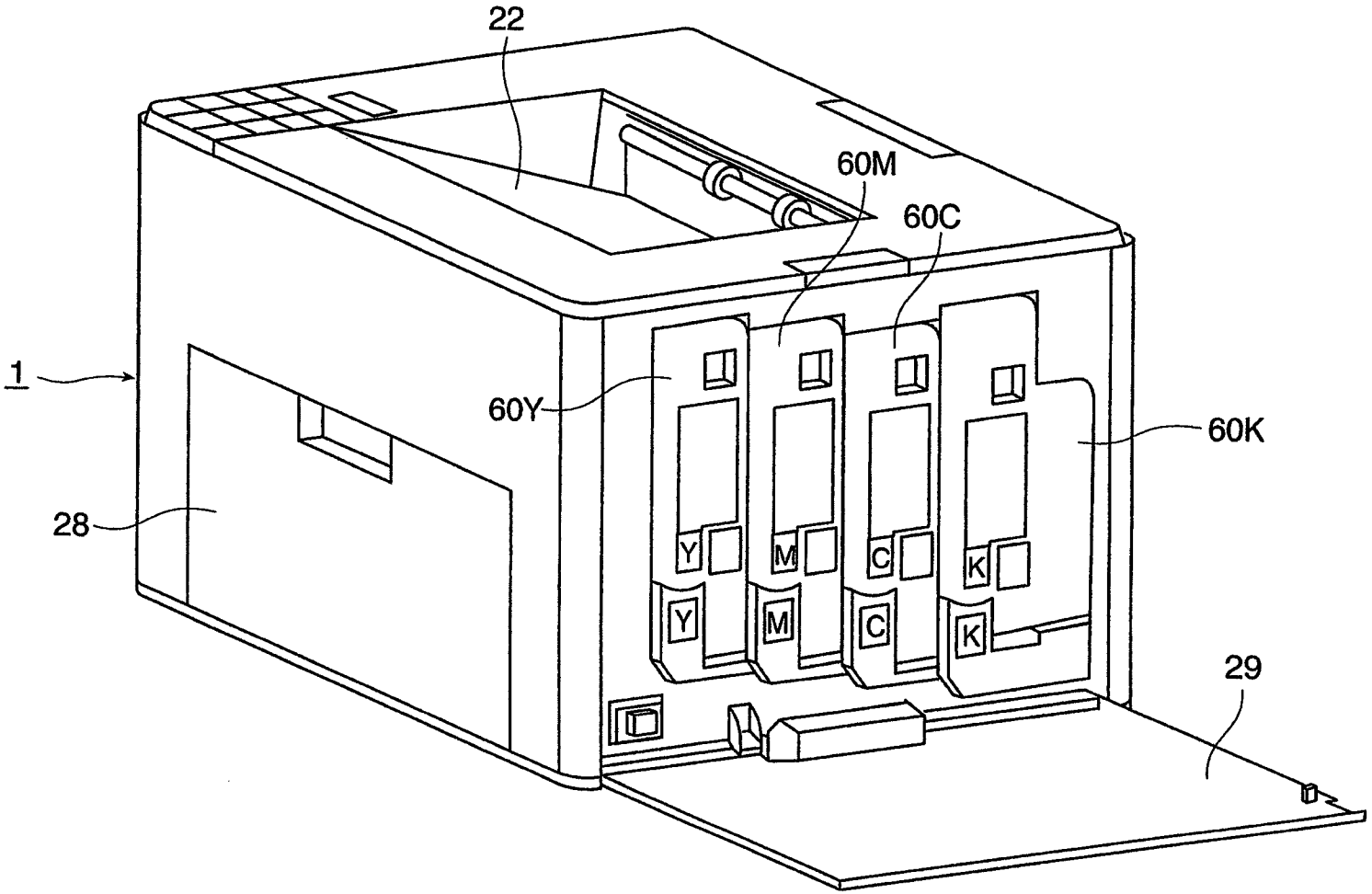
FIG. 5 is a perspective view showing a general appearance of the printer main body (a side cover is open)
Figure 6:
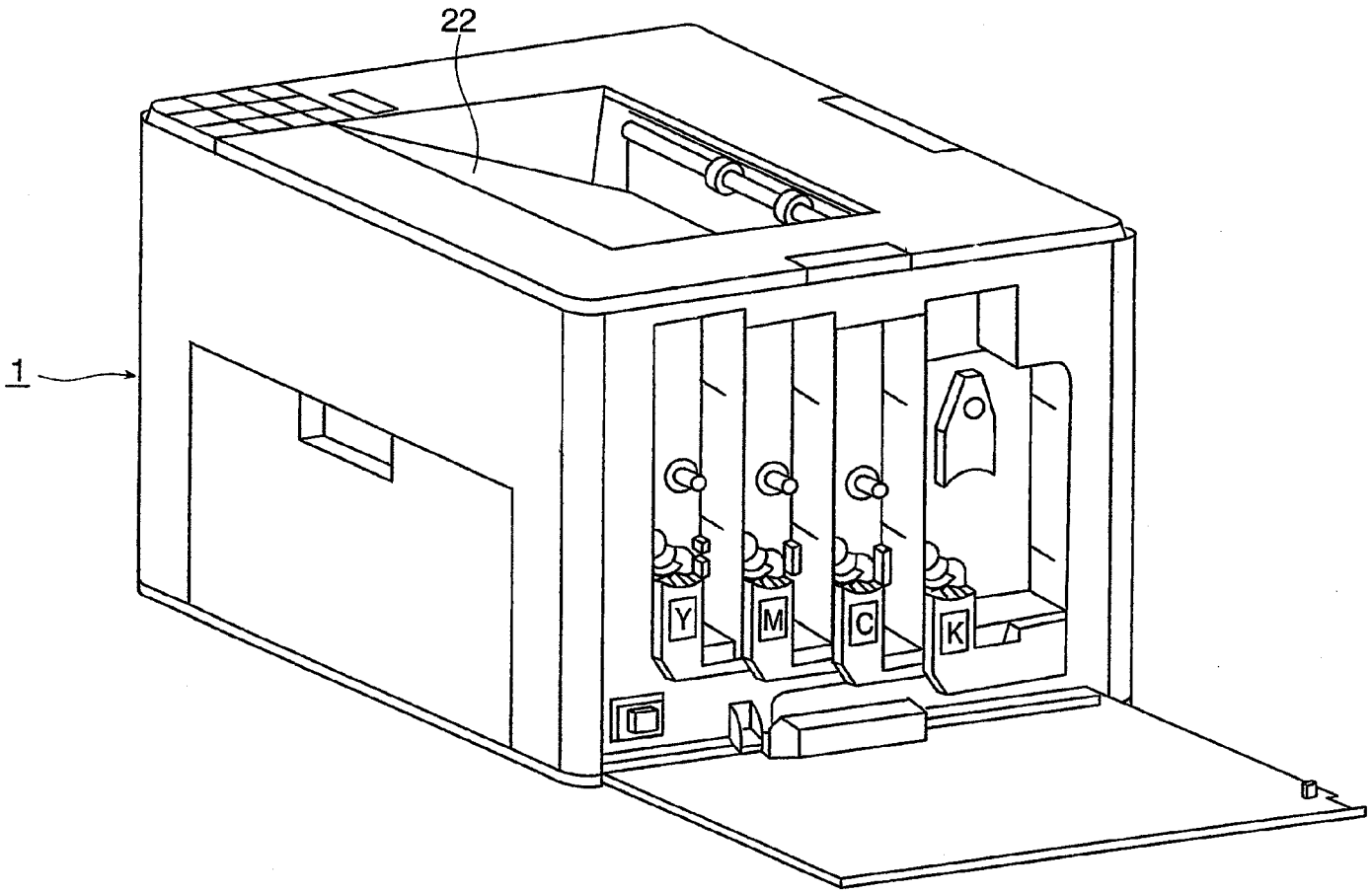
FIG. 6 is a perspective view showing another general appearance of the printer main body (the side cover is open)

As shown in FIGS. 4-6, a main body 1 of the color printer is generally shaped like a rectangular parallelepiped. A front cover 28 for, for example, supply of recording sheets is provided in the front wall of the printer main body 1 so as to be openable and closable. A side cover 29 as an opening/closing door for, for example, replacement of toner cartridges 60Y, 60M, 60C, and 60K as developer containers which are replaceable members is provided in a side wall of the printer main body 1. An ejected sheet tray 22 to which image-formed recording sheets are to be ejected is formed as part of a top portion of the printer main body 1.

In the color printer, as shown in FIG. 5, one or some of the toner cartridges 60Y, 60M, 60C, and 60K is or are, for example, replaced or subjected to a check of its mounting state by exposing the toner cartridges 60Y, 60M, 60C, and 60K by opening the side cover 29.

Figure 7:
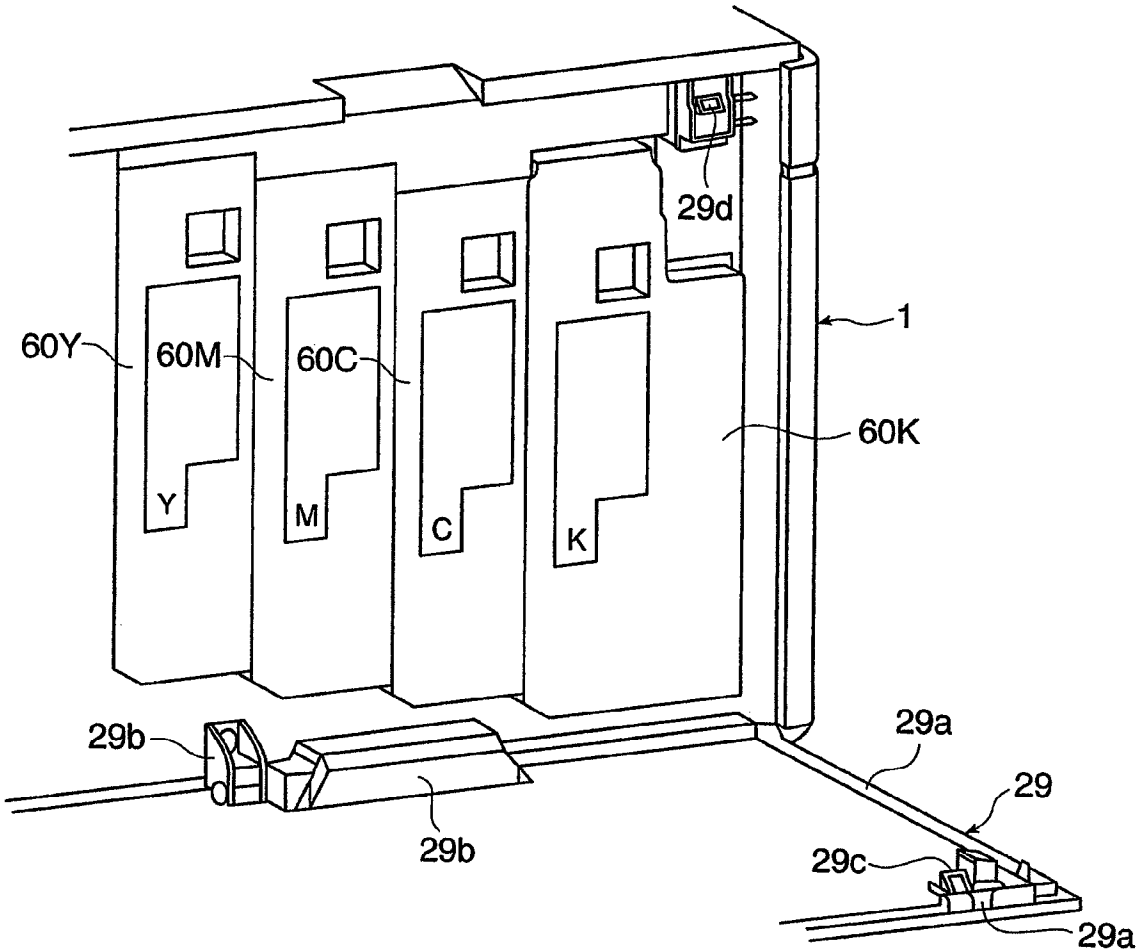
FIG. 7 is a perspective view showing a general appearance of an important part of the printer main body (the side cover is open)
Figure 8:
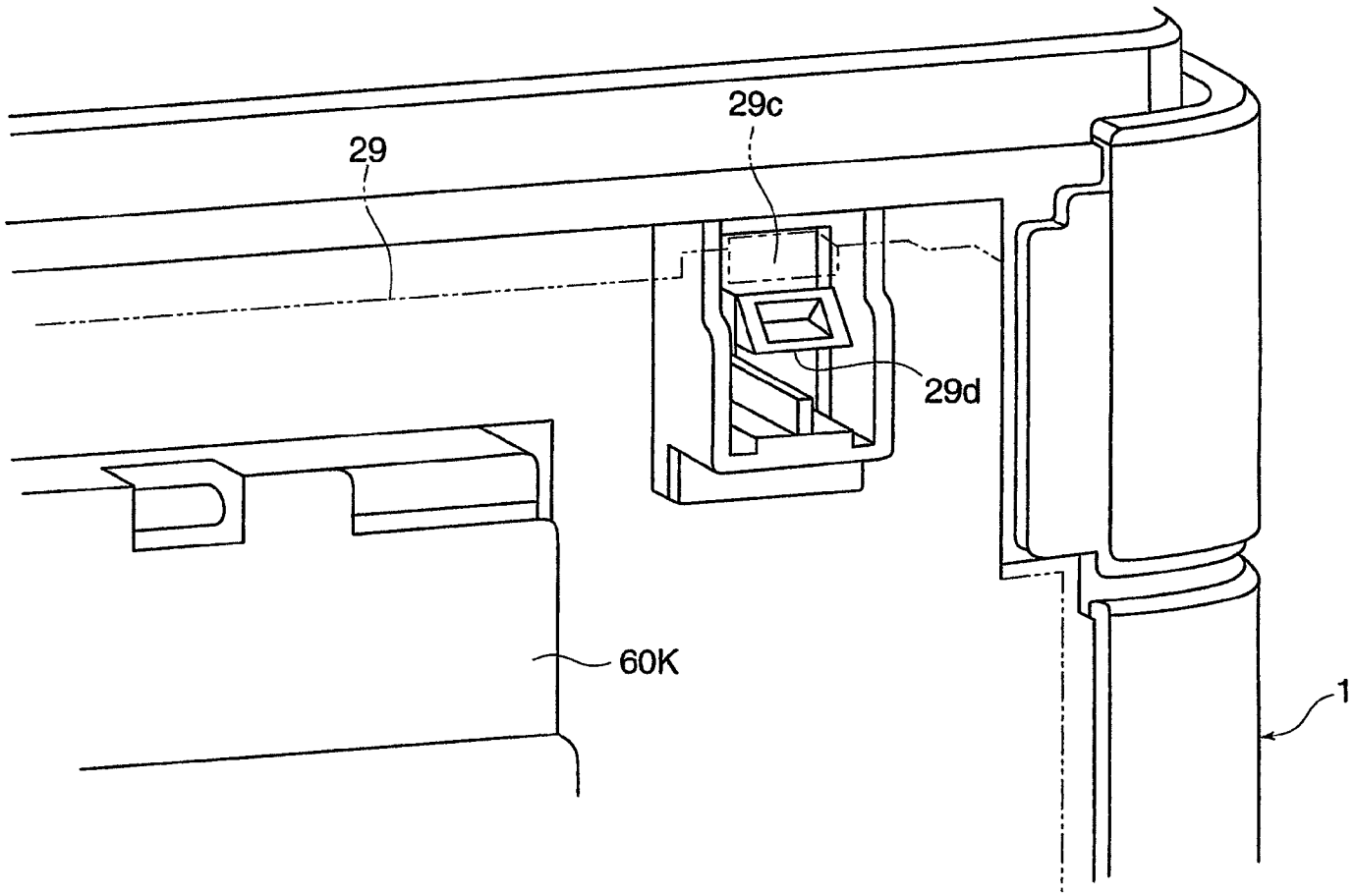
FIG. 8 is a perspective view showing a general appearance of another important part of the printer main body (the side cover is open)

In the exemplary embodiment, as shown in FIGS. 7 and 8, no detecting means for detecting opening or closing of the side cover 29 (opening/closing door) for, for example, replacement of the toner cartridges 60Y, 60M, 60C, and 60K is provided. And, to reduce the size and the cost of the printer main body 1, the side cover 29 is comparatively thin and is relatively low in rigidity. Although comparatively thin, as shown in FIG. 7 the side cover 29 is sufficiently rigid because flat-plate-like frame members 29*a* are erected low from the inner surface of the side cover 29 at the top end, the left end, and the right end. Opening/closing members 29*b* provided at the bottom end of the side cover 29 allow the side cover 29 to be attached to the printer main body 1 so as to be rotated by about 90° between a closed state and an approximately horizontal open state.

As shown in FIG. 7, a top-rear corner portion of the inner surface of the side cover 29 is formed with a fixing projection 29*c* for fixing an inside corner portion of the side cover 29 to the printer main body 1 when the side cover 29 is closed. As shown in FIG. 8, the fixing projection 29*c* is held by a holding member 29*d* which is provide at a corresponding portion of the printer main body 1. The holding member 29*d* is provided with a pressing member (not shown) for pressing the fixing projection 29*c* of the side cover 29 from above. The side cover 29 of the side cover 29 is held by pressing it with the pressing member.

As shown in FIG. 2, an image processing unit 3 for performing, when necessary, predetermined image processing such as shading correction, positional deviation correction, lightness/color space conversion, gamma correction, frame erasure, and color/movement editing on image data that is supplied from the personal computer (PC) 2, the image reading device (not shown), or the like and a control unit 4 for controlling operations of the entire color printer are provided inside the printer main body 1.

Image data that has been subjected to the above-mentioned predetermined image processing in the image processing section 3 is converted into image data of four colors (yellow (Y), magenta (M), cyan (C), and black (K)) also by the image processing section 3, and output as a full-color image or a monochrome image in a manner described below by an image output unit 5 which is provided inside the printer main body 1.

As shown in FIG. 2, image forming units 6Y, 6M, 6C, and 6K of the four colors (Y, M, C, and K) are provided inside the printer main body 1. The image forming units 6Y, 6M, 6C, and 6K are arranged in series at regular intervals in a direction that is inclined from the horizontal direction by a predetermined angle (e.g., about 10°) in such a manner that the image forming unit 6Y of Y (first color) is highest and the image forming unit 6K of K (last color) is lowest. It goes without saying that the inclination angle of the image forming units 6Y, 6M, 6C, and 6K is not limited to about 10° and may be larger than or smaller than about 10°.

Arranging the four toner cartridges 60Y, 60M, 60C, and 60K of Y, M, C, and K in the direction that is inclined by the predetermined angle can make the horizontal distances between them shorter than in a case that they are arranged in the horizontal direction, whereby the width of the printer main body 1 can be reduced to contribute to its further miniaturization.

The four image forming units 6Y, 6M, 6C, and 6K basically have the same configurations except for the colors of images to be formed. As shown in FIGS. 2 and 3, each of the image forming units 6Y, 6M, 6C, and 6K is generally composed of a photoreceptor drum 8 as an image holding body which is rotationally driven by a driving means (not shown) at a predetermined speed in the direction indicated by arrow A, a charging roll 9 for primary charging for charging the surface of the photoreceptor drum 8 uniformly, an image exposing device 7 (LED print head) for forming an electrostatic latent image on the surface of the photoreceptor drum 8 by exposing the surface to light according to image data corresponding to the predetermined color, a developing device 10 for developing the electrostatic latent image formed on the photoreceptor drum 8 with a toner of the predetermined color, and a cleaning device 11 for cleaning the surface of the photoreceptor drum 8.

For example, the photoreceptor drum 8 is shaped like a drum of about 30 mm in diameter and has, as a surface coat, a photoreceptor layer made of an organic photoconductor (OPC) or the like. The photoreceptor drum 8 is rotationally driven by a drive motor (not shown) at the predetermined speed in the direction indicated by arrow A.

For example, the charging roll 9 is a roll-shaped charger in which the surface of a core metal member is covered with a conductive layer which is made of a synthetic resin or a synthetic rubber and adjusted in electric resistivity. A predetermined charging bias is applied to the core metal member of the charging roll 9.

As shown in FIG. 2, the image exposing device 7, which is provided in each of the four image forming units 6Y, 6M, 6C, and 6K, is equipped with an LED array in which LEDs are arranged linearly parallel with the axial direction of the photoreceptor drum 8 at a prescribed pitch (e.g., 600 to 1,200 dpi) and a rod lens array for focusing light beams emitted from the LEDs of the LED array into spots. As shown in FIGS. 2 and 3, the image exposing device 7 is configured so as to scan-expose the photoreceptor drum 8 from below.

Using the LED array as a component of the image exposing device 7 is desirable because the size of the image exposing device 7 can be reduced to a large extent. However, the image exposing device 7 is not limited to the type using an LED array and may be, for example, of a type in which a laser beam is deflected for a scan in a direction that is parallel with the axial direction of the photoreceptor drum 8. In this case, for example, one image exposing device 7 is provided for the four image forming units 6Y, 6M, 6C, and 6K.

Image data of the respective colors are sequentially output from the image processing unit 3 to the corresponding image exposing devices 7Y, 7M, 7C, and 7K which are provided for the respective image forming units 6Y, 6M, 6C, and 6K of Y, M, C, and K. The surface of the photoreceptor drums 8Y, 8M, 8C, and 8K are scan-exposed to light beams emitted from the image exposing devices 7Y, 7M, 7C, and 7K according to the image data, whereby electrostatic latent images are formed on the photoreceptor drums 8Y, 8M, 8C, and 8K. The electrostatic latent images formed on the photoreceptor drums 8Y, 8M, 8C, and 8K are developed into toner images of Y, M, C, and K by the developing devices 10Y, 10M, 100, and 10K.

The toner images of Y, M, C, and K which have been formed sequentially on the photoreceptor drums 8Y, 8M, 8C, and 8K of the image forming units 6Y, 6M, 6C, and 6K are primarily transferred, sequentially, in superimposition, to an intermediate transfer belt 12 which is an endless intermediate transfer body and is disposed with inclination over the image forming units 6Y, 6M, 6C, and 6K by four primary transfer rolls 13Y, 13M, 13C, and 13K.

The intermediate transfer belt 12 is an endless belt which is stretched by plural rolls and inclined from the horizontal direction in such a manner that the downstream side of its bottom portion in its running direction is lower than the upstream side.

That is, as shown in FIG. 2, the intermediate transfer belt 12 is wound with predetermined tension on a follower roll 14 and a drive roll 15 which also functions as a backside support roll of a secondary transfer unit. The intermediate transfer belt 12 is circulated at a predetermined speed in the direction indicated by arrow B by the drive roll 15 which is rotationally driven by a drive motor (not shown) which is superior in constant speed characteristic. For example, the intermediate transfer belt 12 is an endless belt of flexible synthetic resin film made of polyimide, polyamide-imide, or the like. The intermediate transfer belt 12 is disposed so that its bottom running portion is in contact with the photoreceptor drums 8Y, 8M, 8C, and 8K of the image forming units 6Y, 6M, 6C, and 6K.

As shown in FIG. 2, a secondary transfer roll 17 as a secondary transfer means is disposed adjacent to the lower end of the intermediate transfer belt 12 and serves to secondarily transfer toner images that have been primarily transferred to the intermediate transfer belt 12 to a recording medium 16. That is, the secondary transfer roll 17 is disposed so as to be in contact with the surface of that portion of the intermediate transfer belt 12 which is wound on the drive roll 15.

As shown in FIG. 2, toner images of Y, M, C, and K that have been transferred to the intermediate transfer belt 12 in superimposition are secondarily transferred to a recording sheet 16 (recording medium) by the secondary transfer roll 17 which is in contact with the drive roll 15 via the intermediate transfer belt 12. The recording sheet 16 to which the toner images of the respective colors have been transferred is conveyed to a fusing device 18 which is located above the secondary transfer roll 17. The secondary transfer roll 17 is pressed against the drive roll 15 from its side via the intermediate transfer belt 12, and secondarily transfers toner images of the respective colors together to a recording sheet 16 being conveyed upward.

For example, the secondary transfer roll 17 is configured in such a manner that the outer circumferential surface of a core metal member made of such a metal as stainless steel is covered with an elastic layer having a predetermined thickness and made of a conductive elastic material such as a synthetic rubber that is added with a conductive agent.

The toner images of the respective colors have been transferred to the recording sheet 16 are fused by heat and pressure by a heating roll 19 and a pressure belt (or pressure roll) 20 of the fusing device 18, and then the recording sheet is ejected, with the image-formed surface down, onto the ejected sheet tray 22 which is part of the top portion of the printer main body 1.

As shown in FIG. 2, a single recording sheet 16 having a predetermined size and made of a predetermined material is supplied from a sheet supply tray 23 disposed at the bottom of the printer main body 1 and separated by means of a sheet supply roll 24 and a sheet separation roll 25, conveyed to a registration roll 26, and stopped there. Then, the recording sheet 16 is sent out to the secondary transfer position of the intermediate transfer belt 12 by the registration roll 26 which is rotationally driven in synchronism with toner images on the intermediate transfer belt 12. Recording sheets 16 are not limited plain sheets; thick sheets such as coat sheets whose front surfaces or front and back surfaces were subjected to coating can also be supplied. Photograph images etc. are output to coat sheets as recording sheets 16.

As shown in FIGS. 2 and 3, residual toner is removed by the cleaning device 11 from the surface of each photoreceptor drum 8 that has been subjected to primary transfer of a toner image, to prepare for the next image forming process. As shown in FIG. 2, residual toner etc. are removed from the surface of intermediate transfer belt 12 that has been subjected to secondary transfer of toner images, by a belt cleaning device which is disposed adjacent to the drive roll 15 on the downstream side, to prepare for the next image forming process.

Figure 9A:
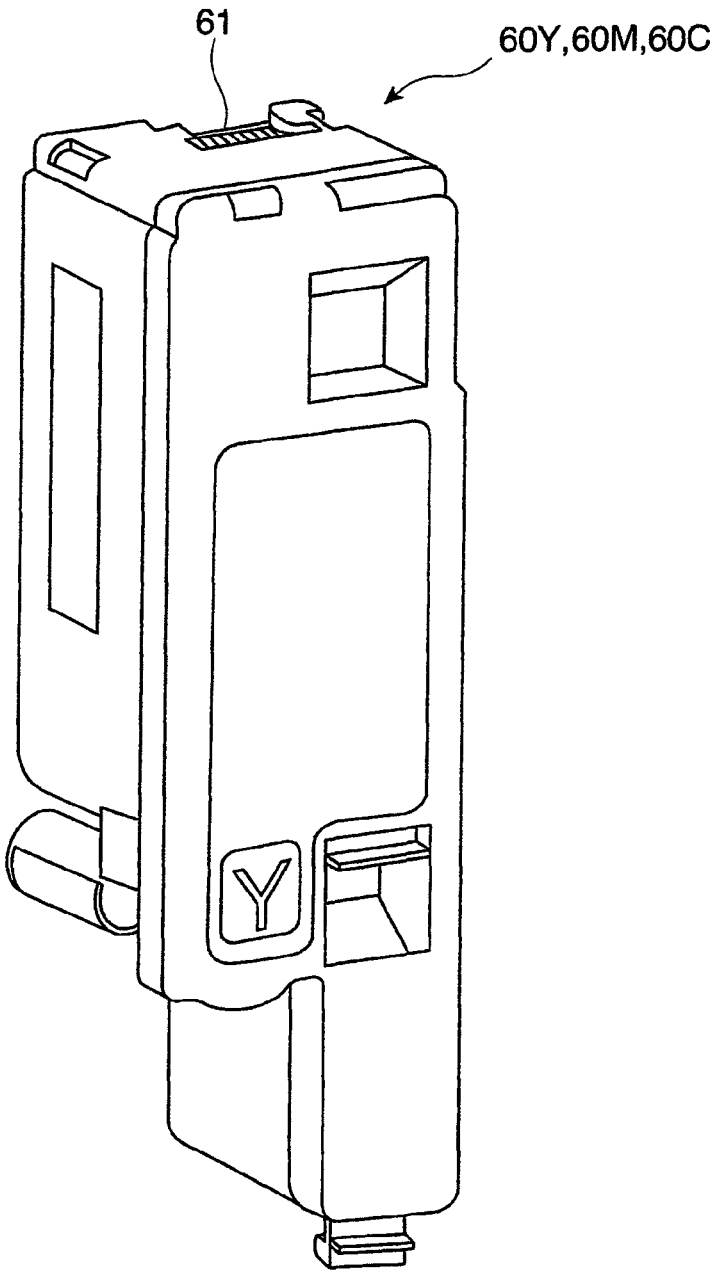
FIG. 9A is a perspective view showing a general appearance of a toner cartridge used in the color printer according to the exemplary embodiment.

FIG. 9A is a perspective view showing a general appearance of a toner cartridge used in the tandem color printer which is the image forming apparatus according to the exemplary embodiment of the invention.

As shown in FIG. 9, the toner cartridges 60Y, 60M, and 60C of Y, M, and C have the same shape, that is, a long and narrow rectangular parallelepiped (long in the vertical direction). On the other hand, as shown in FIG. 5, the toner cartridge 60K of black (K) is wider than the color toner cartridges 60Y, 60M, and 60C and hence can contain a larger amount of developer. The toner cartridges 60Y, 60M, 60C, and 60K contain developers that include at least respective toners, and developer can be supplied to each of the developing devices 10Y, 100, 10M, and 10K through a supply hole (not shown) of the corresponding one of the toner cartridges 60Y, 60M, 60C, and 60K by rotationally driving a developer supply member (not shown) with a drive motor with predetermined timing. An amount of developer that has been supplied from each of the toner cartridges 60Y, 60M, 60C, and 60K to the corresponding one of the developing devices 10Y, 100, 10M, and 10K can be measured by measuring (counting) an accumulated drive time of the drive motor.

Figure 9B:
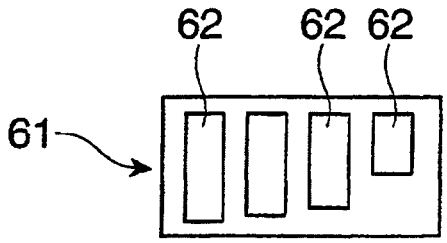
FIG. 9B is an enlarged view showing a memory device of the toner cartridge in FIG. 9A.

As shown in FIGS. 9A and 9B, the top wall of each of the toner cartridges 60Y, 60M, 60C, and 60K is equipped with a memory device 61 (storage means). Electrode terminals 62, formed on the top wall of each of the toner cartridges 60Y, 60M, 60C, and 60K, of the memory device 61 are connected to electrodes on the printer main body 1 side, whereby a user ID, a toner/developer use amount or residual amount, and other information stored in the memory device 61 can be read from the outside or information can be written to the memory device 61 if necessary. A count value of a counter for measuring (counting) an accumulated drive time of the drive motor is stored in the memory device 61 with predetermined timing, whereby an amount of developer that has been supplied from the corresponding one of the toner cartridges 60Y, 60M, 60C, and 60K can be measured.

The memory device 61 is not limited to a contact type which uses the electrode terminals 62. The memory device 61 may naturally be of a type (e.g., RFI (radio frequency identification) type) which is capable of radio communication and enables information reading and writing in a non-contact state. It suffices that the memory device 61 be configured so as to enable at least reading of information stored in it from the outside. That is, the memory device 61 is not necessarily required to enable writing of information to it from the outside.

Figure 10:
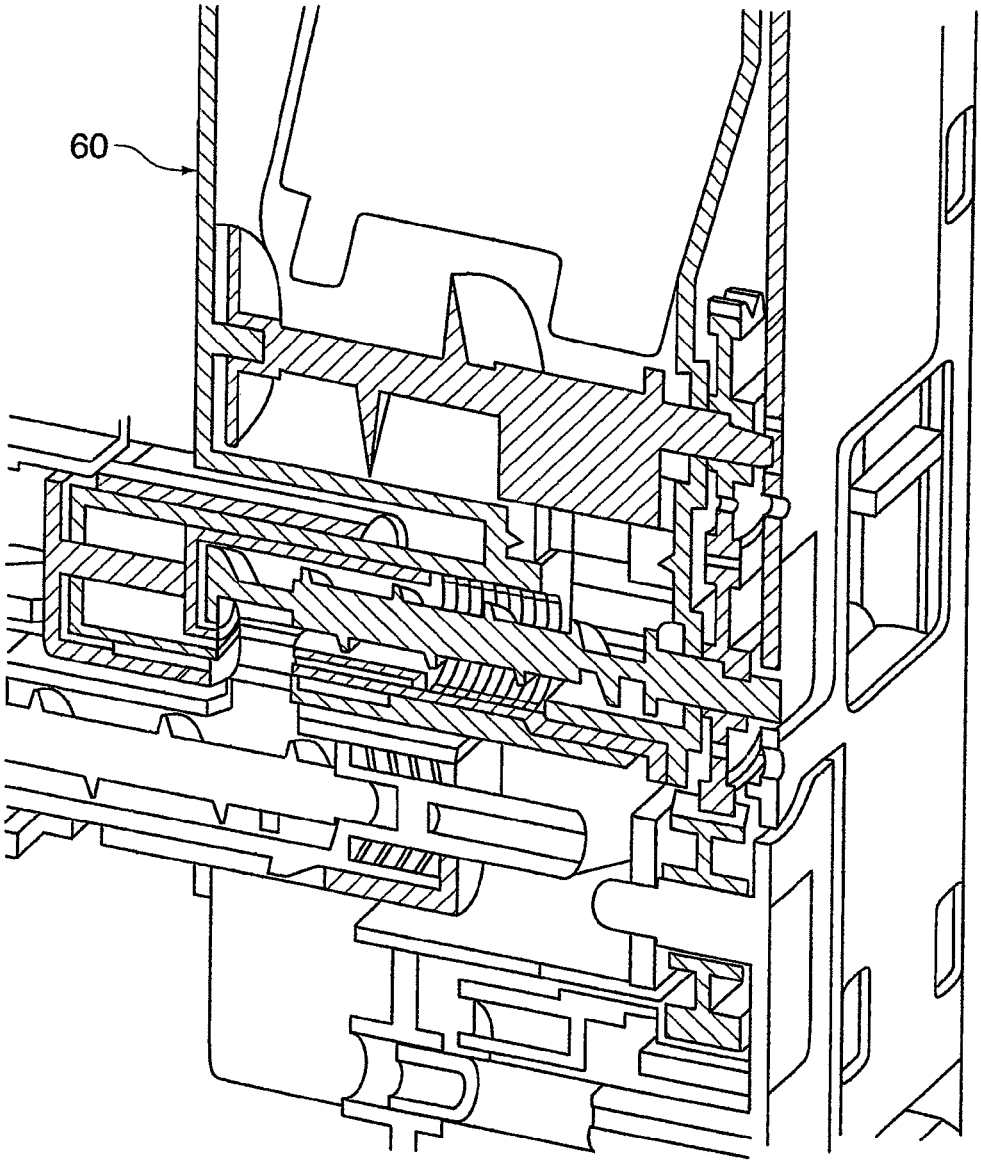
FIG. 10 is a partially sectional perspective view of a toner cartridge mounting portion of the according to the exemplary embodiment.
Figure 11:
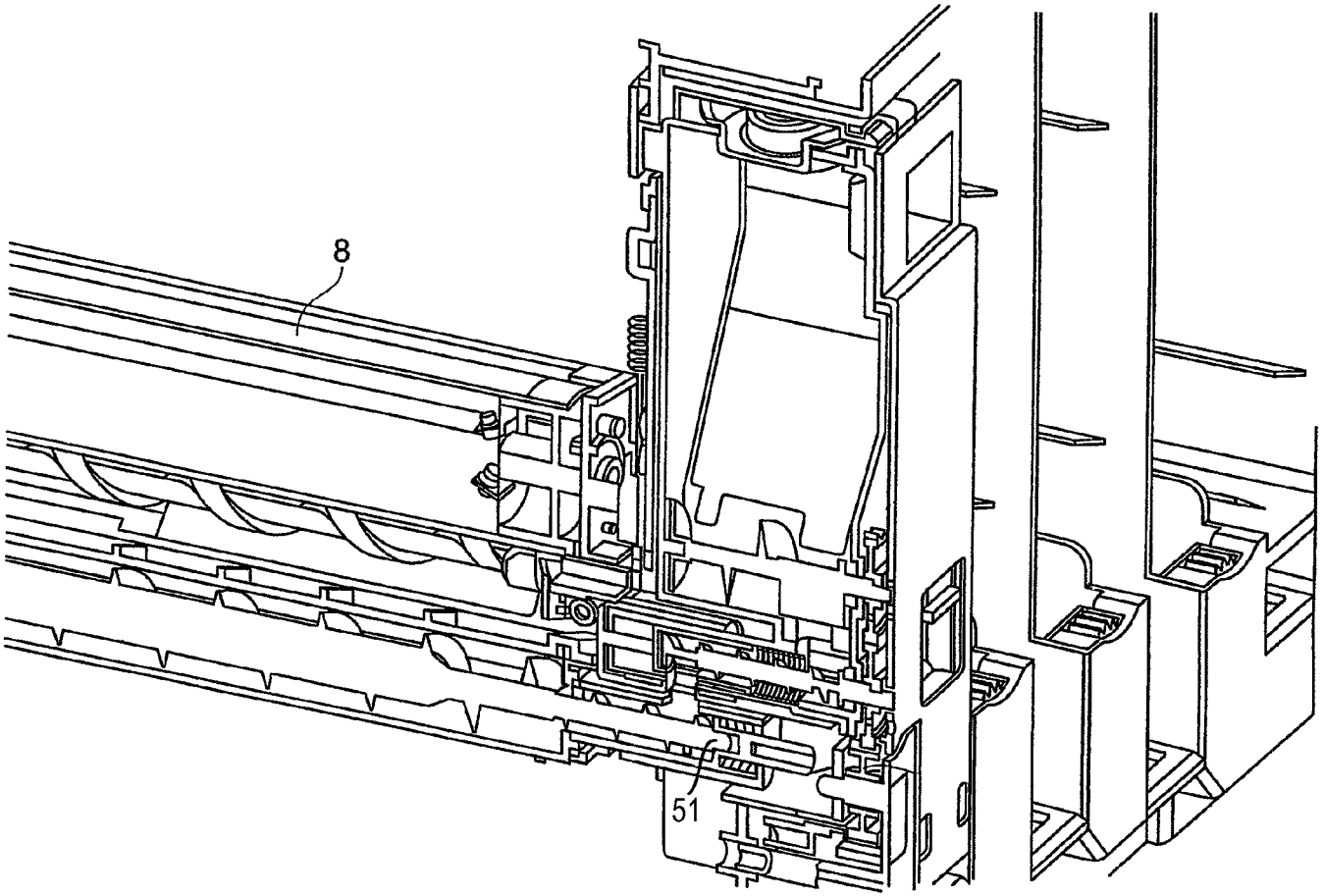
FIG. 11 is another partially sectional perspective view of a toner cartridge mounting portion of the according to the exemplary embodiment.

When the toner cartridges 60Y, 60M, 60C, and 60K are mounted in the printer main body 1 in the manner shown in FIG. 5, as shown in FIGS. 10 and 11 rotational drive force is transmitted from a drive gear (not shown) provided in the printer main body 1 to each of the toner cartridges 60Y, 60M, 60C, and 60K and the developer supply member provided inside each of the toner cartridges 60Y, 60M, 60C, and 60K is driven rotationally, whereby developer is supplied.

In the color printer, as shown in FIG. 11, if one of the toner cartridges 60Y, 60M, 60C, and 60K is removed from the printer main body 1, a supply provided on the printer main body 1 side is projected outward by elastic force of a coil spring so as to cover the drive gear from above. As a result, when the side cover 29 is opened, the user is prevented from touching the drive gear inadvertently even if all or part of the toner cartridges 60Y, 60M, 600, and 60K are removed.

Figure 12:
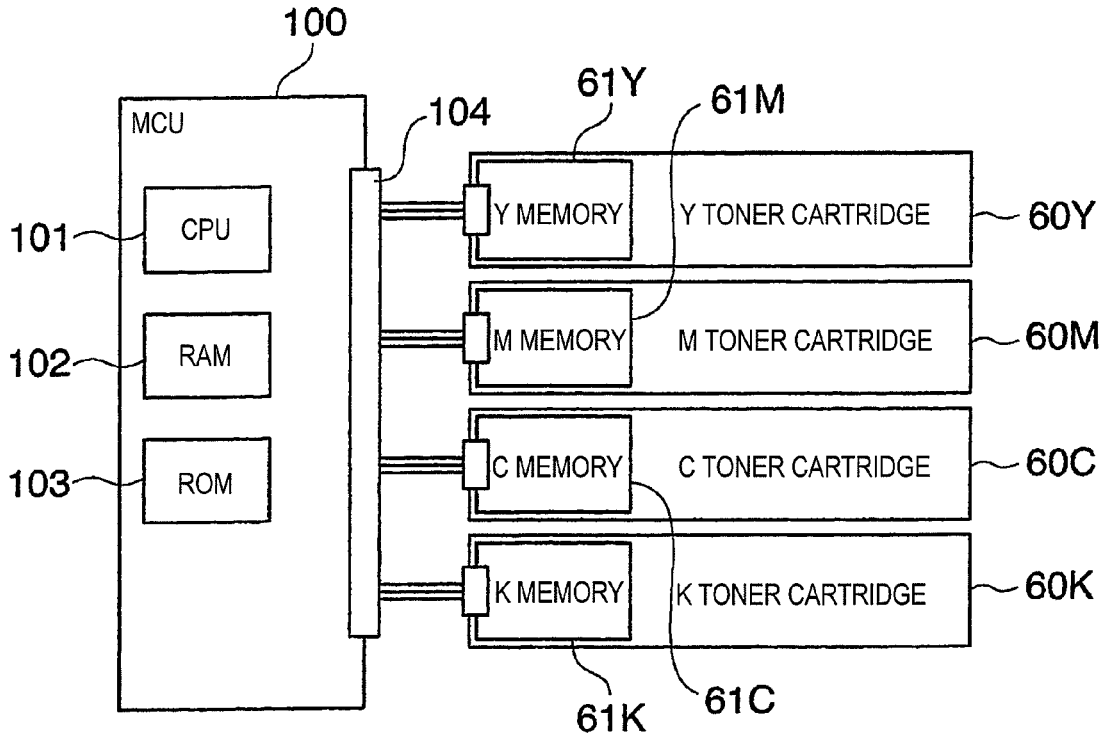
FIG. 12 is a bock diagram of a control unit of the color printer according to the exemplary embodiment.

FIG. 12 is a bock diagram of the control unit 4 of the color printer which is the image forming apparatus according to the exemplary embodiment of the invention.

In FIG. 12, reference numeral 100 denotes a machine control unit of the color printer. As shown in FIG. 12, the machine control unit 100 is equipped with a CPU 101 as a control means for controlling operations of the color printer, a RAM 102 for storing parameters etc. to be used for controlling the operations of the color printer, a ROM 103 for storing programs for controlling the operations of the color printer, a user ID for identification of the color printer, information relating to the developers contained in the toner cartridges 60Y, 60M, 60C, and 60K, and other information, and an input/output interface 104 to be used for connecting the CPU 101 to an external apparatus. Connected to the memory devices 61Y, 61M, 61C, and 61K of the toner cartridges 60Y, 60M, 60C, and 60K via the input/output interface 104, the CPU 101 of the machine control unit 100 can, for example, check whether or not it is electrically connected to the memory devices 61Y, 61M, 61C, and 61K and write and read data to and from the memory devices 61Y, 61M, 61C, and 61K.

In addition to functioning as the control means, the CPU 101 functions as a response reception/non-reception determining means 120 for determining whether or not a response has been received from a storage means of a member to be replaced, and as a detecting means 121 for determining that the opening/closing door has been opened and closed or the member to be replaced has been removed if the reception/non-reception determining means has produced, a predetermined number of times, a judgment result meaning non-reception of a response from the storage means.

The CPU 101 also functions as a readability determining means 122 for determining whether at least reading of information stored in the storage means of the member to be replaced is possible or not, and as an abnormality detecting means 123 for detecting (determining) that the member to be replaced has an abnormality if the readability determining means has produced, a predetermined number of times, a judgment result meaning impossibility of reading of information stored in the storage means.

Figure 13:
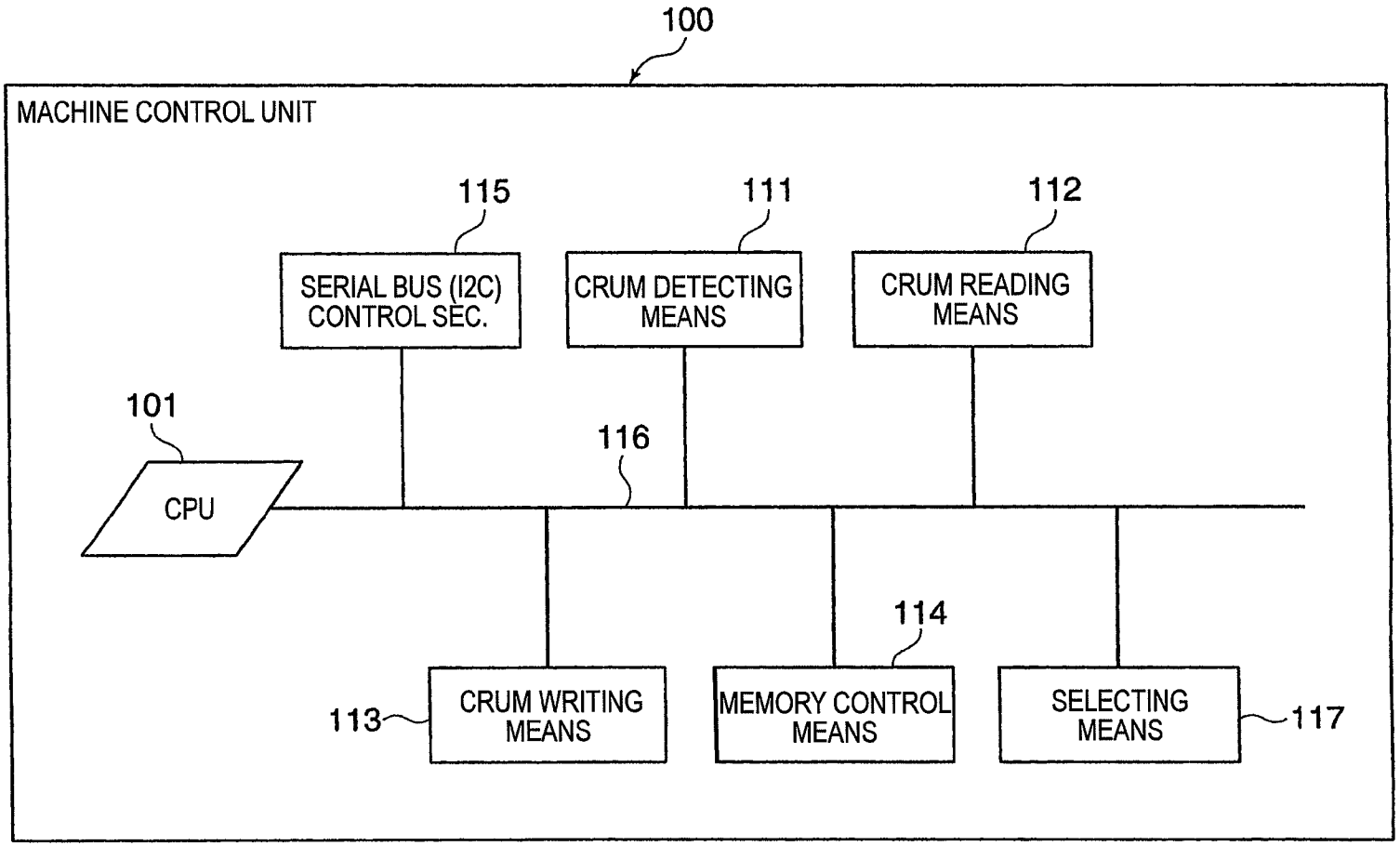
FIG. 13 is a bock diagram of a machine control unit of the color printer according to the exemplary embodiment.

FIG. 13 is a bock diagram of the machine control unit 100 of the color printer.

A memory (CRUM) that stores information on toner or the like may be built in a toner cartridge of the image forming apparatus.

As shown in FIG. 13, the CPU 101 of the machine control unit 100 is equipped with a CRUM detecting means 111 for detecting the memory devices 61Y, 61M, 61C, and 61K which are provided in the toner cartridges 60Y, 60M, 60C, and 60K. The CRUM detecting means 111 detects presence/absence of each memory device 61 and hence presence/absence of each toner cartridge 60 by detecting a resistance value associated with the electrodes 62 of each memory device 61 or particular data stored in each memory device 61. A CRUM reading means 112 is a means for reading data from each memory device 61, and a CRUM writing means 113 is a means for writing data to each memory device 61. A memory control means 114 is a means for controlling the storage media such as the RAM 102 and the ROM 103 of the printer main body 1. A selecting means 117 is a means for selecting between continuation/non-continuation of an ongoing image forming operation when the CPU 101 (detecting means) detects removal of a toner cartridge 60 during execution of the image forming operation. Usually, the selecting means 117 is composed of a user interface of the printer, a printer driver, etc. If the selecting means selects continuation of an ongoing image forming operation, the ongoing image forming operation is continued even if the CPU 101 detects removal of the toner cartridge 60. A serial bus control section 115 is a means for enabling data exchange by controlling a serial bus 116 which connect the CPU 101, the CRUM detecting means 111, the CRUM reading means 112, the CRUM writing means 113, the memory control means 114, etc.

All or part of the CRUM detecting means 111, the CRUM reading means 112, the CRUM writing means 113, and the memory control means 114 need not always be hardware and may be software.

In a manner to be described below, the above-configured color printer according to the exemplary embodiment can detect, for example, replacement of a developer container without providing any means for detecting, for example, opening/closure of the opening/closing door for attachment/detachment of the developer containers.

When the color printer is purchased, the toner cartridges 60Y, 60M, 60C, and 60K of Y, M, C, and K are already mounted in the color printer (see FIG. 5) and the color printer can be used as soon as it is connected to another apparatus such as the personal computer 2 (see FIG. 2). In the exemplary embodiment, it is assumed that the toner cartridges 60Y, 60M, 60C, and 60K are incorporated in the color printer when it is purchased. Naturally, the toner cartridges 60Y, 60M, 60C, and 60K may be separated from the printer main body 1 when the printer is purchased, in which case the user mounts the toner cartridges 60Y, 60M, 60C, and 60K into the printer main body 1 by himself or herself.

In starting to use the color printer, the user may check whether the toner cartridges 60Y, 60M, 60C, and 60K are mounted or not or, if necessary, replace or do some other work on one or some of the toner cartridges 60Y, 60M, 60C, and 60K by opening the side cover 29 of the printer main body 1 (see FIG. 5).

Figure 14:
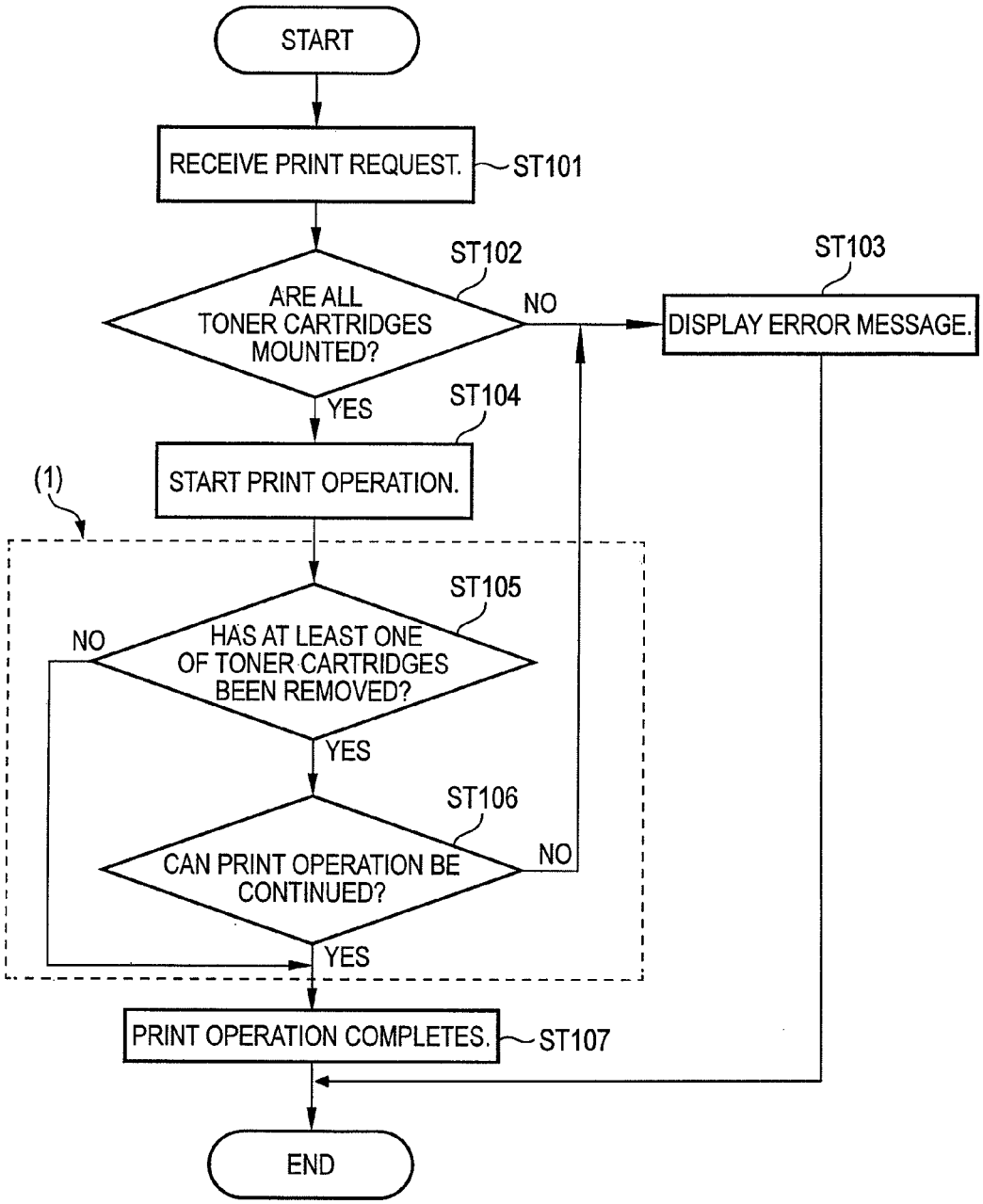
FIG. 14 is a flowchart of a basic process which is executed by the color printer according to the exemplary embodiment.

In the exemplary embodiment, as shown in FIG. 14, the CPU 101 not only controls operations of the entire color printer but also detects attachment/detachment of the toner cartridges 60Y, 60M, 60C, and 60K and opening/closure of the side cover 29 of the printer main body 1 and perform other related operations.

As shown in FIG. 14, when the color printer is powered on, the CPU 101 performs an initialization operation and receives a print request at step 101. At step 102, the CPU 101 determines whether or not all of the toner cartridges 60Y, 60M, 60C, and 60K are mounted. If determining that not all of the toner cartridges 60Y, 60M, 60C, and 60K are mounted (step 102: no), at step 103 the CPU 101 displays, on a display means (not shown), an error message to the effect that not all of the toner cartridges 60Y, 60M, 60C, and 60K are mounted. Then, the process is finished.

If determining that all of the toner cartridges 60Y, 60M, 60C, and 60K are mounted (step 102: yes), at step 104 the CPU 101 performs a print operation. Until completion of the print operation, the CPU 101 determines, in parallel, at a prescribed cycle, whether at least one of the toner cartridges 60Y, 60M, 60C, and 60K has been removed or not (step 105) and whether the print operation can be continued or not (e.g., by checking a toner density; step 106). If determining that the print operation cannot be continued because of, for example, removal of at least one of the toner cartridges 60Y, 60M, 60C, and 60K, at step 103 the CPU 101 displays an error message. Then, the process is finished.

Example conditions (employed at step 106) for continuation of the print operation in spite of the judgment that at least one of the toner cartridges 60Y, 60M, 60C, and 60K has been removed are that the amount of toner remaining in each corresponding developing device 10 (calculated through density calculation with detection of a toner patch) is sufficient for the number of prints to be produced, that the removed toner cartridge(s) 60 will not be used for the printing (e.g., the toner cartridges 60Y, 60M, and 60C are removed whereas a monochrome image is to be formed), and that information of the memory device 61 of each removed toner cartridge 60 is not necessary in the printing.

The print operation is completed at step 107, and then the process is finished.

Figure 1:
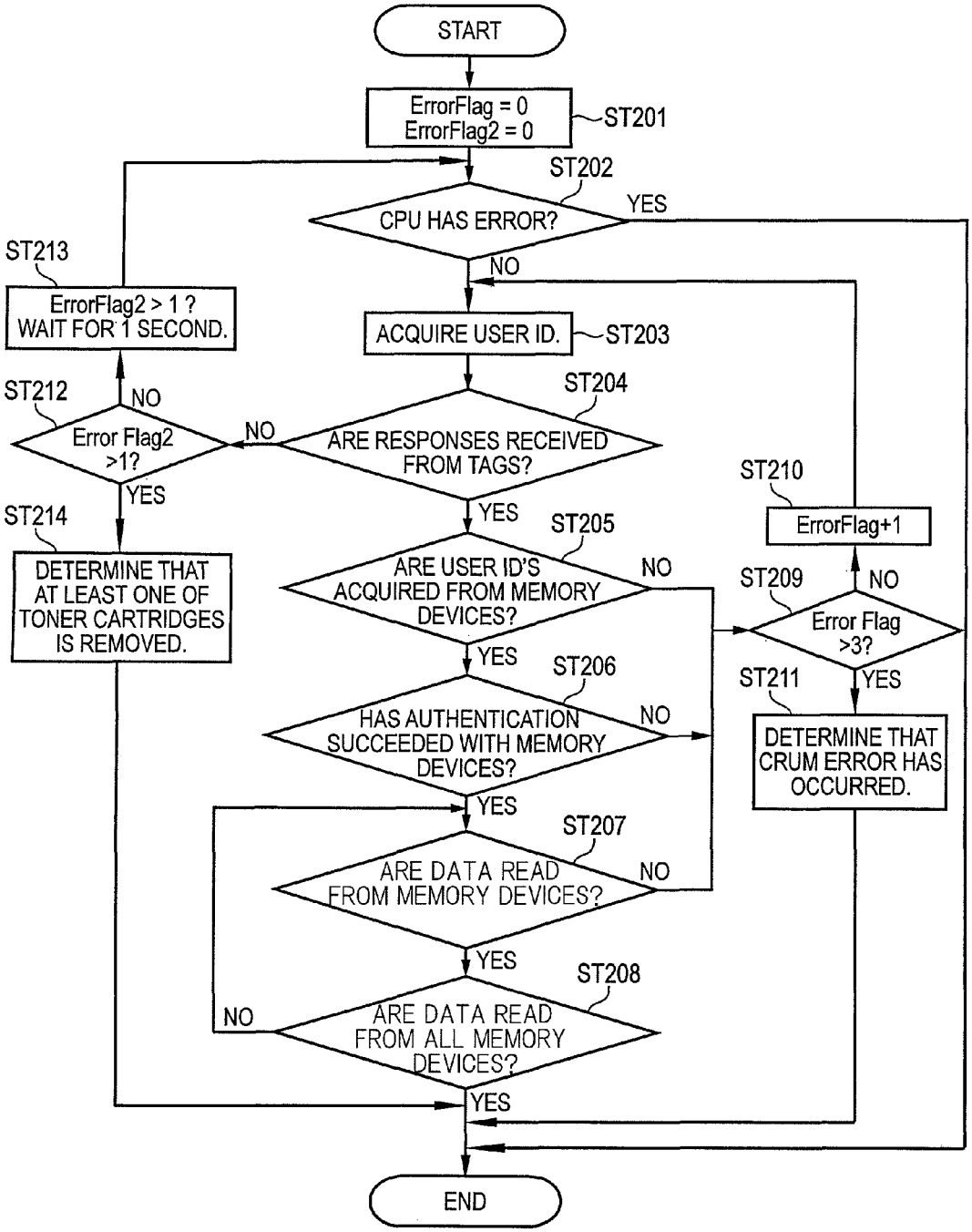
FIG. 1 is a flowchart of a process (a detailed version of the process of FIG. 14) which is executed by a tandem color printer which is an image forming apparatus according to an exemplary embodiment of the present invention.

FIG. 1 is a flowchart of a detailed version of the process of FIG. 14.

As shown in FIG. 1, at step 201, the CPU 101 sets both control parameters ErrorFlag and ErrorFlag2 to "0." At step 202, the CPU 101 determines whether or not at least one of the toner cartridges 60Y, 60M, 60C, and 60K (members to be replaced) has an error.

Since the toner cartridges 60Y, 60M, 60C, and 60K should not have an error initially, at step 203 the CPU 101 acquires a user ID of the color printer (user IDs are set for respective color printers) from the ROM 103, which is a memory provided in the printer main body 1. At step 204, the CPU 101 determines whether or not responses are received from the memory devices (hereinafter also referred to as tags) 61 of the toner cartridges 60Y, 60M, 60C, and 60K using the CRUM detecting means 111 (see FIG. 13). Whether or not responses are received from all of the memory devices 61 may be determined on the basis of whether or not predetermined data is stored in the memory devices 61. Alternatively, it may be determined on the basis of a resistance value (the resistance value is infinite if a toner cartridge 60 has no memory device 61) associated with particular ones of the electrodes 62 of each memory device 61 by energizing each memory device 61 via those particular electrodes 62.

If determining that responses are received from the memory devices 61 (step 204: yes), at step 205 the CPU 101 determines whether or not user IDs are acquired from the memory devices 61. If determining that user IDs are acquired from all of the memory devices 61 (step 205: yes), at step 206 the CPU 101 determines whether or not they coincide with the user ID that was acquired at step 203, that is, whether or not the authentication has succeeded.

If determining that the authentication has succeeded (step 206: yes), at step 207 the CPU 101 determines whether or not data are read from the memory devices 61 and at step 208 the CPU 101 determines whether or not all data are read from the memory devices 61. If the CPU 101 determines that all data are read from the memory devices 61, the process is finished.

On the other hand, if determining that a user ID is not received from every memory device 61 (step 205: no)), the authentication has not succeeded with every memory device 61 (step 206: no), or data is not read from every memory device 61 (step 207: no), at step 209 the CPU 101 determines whether or not ErrorFlag is larger than 3. If determining that ErrorFlag is not larger than 3 (step 209: no), at step 210 the CPU 101 adds 1 to ErrorFlag. The process returns to step 203. On the other hand, if determining that ErrorFlag is larger than "3," at step 211 the CPU 101 determines that a CRUM error has occurred in the toner cartridges 60Y, 60M, 60C, and 60K. Then, the process is finished.

If determining that no response is received from the memory device 61 of at least one of the toner cartridges 60Y, 60M, 60C, and 60K (step 204: no), at step 212 the CPU 101 determines whether or not ErrorFlag2 is larger than "1." If determining that ErrorFlag2 is not larger than "1," at step 213 the CPU 101 adds 1 to ErrorFlag2 and waits for 1 second. Then, the process returns to step 202 to perform data reading again.

On the other hand, if determining that ErrorFlag2 is larger than "1," at step 214 the CPU 101 determines that at least one of the toner cartridges 60Y, 60M, 60C, and 60K (members to be replaced) is removed. Then, the process is finished.

An example action that the CPU 101 performs after determining, step 214, that at least one of the toner cartridges 60Y, 60M, 60C, and 60K is removed is to finish the print operation forcibly. However, if determining that the print operation need not be finished forcibly (i.e., it can be continued; described above), naturally the CPU 101 may continue the print operation.

If at least one of the toner cartridges 60Y, 60M, 60C, and 60K is removed while it is attempted to read data from the memory devices 61 of the toner cartridges 60Y, 60M, 60C, and 60K at step 207, data cannot be read from all of the memory devices 61, the process moves to step 209, where it is determined whether or not ErrorFlag is larger than "3." If ErrorFlag is not larger than "3," 1 is added to ErrorFlag. The process moves, via step 203, to step 204, where it is determined whether or not responses are received from all the tags. Since a response is not received from every tag, the process moves, via step 212, to step 213, where the data reading is suspended for 1 second. Since the removal of the at least one of the toner cartridges 60Y, 60M, 60C, and 60K is detected during that course, an error is detected at step 202 after the data reading is started again. Then, the process is finished.

The basic process which is executed by the color printer according to the exemplary embodiment has been described above. In addition, in the exemplary embodiment, the following process is executed parallel with the above-described process to use detection of, for example, presence/absence (attachment/detachment) of the toner cartridges 60Y, 60M, 60C, and 60K for, for example, detection of opening/closure of the side cover 29.

Figure 15:
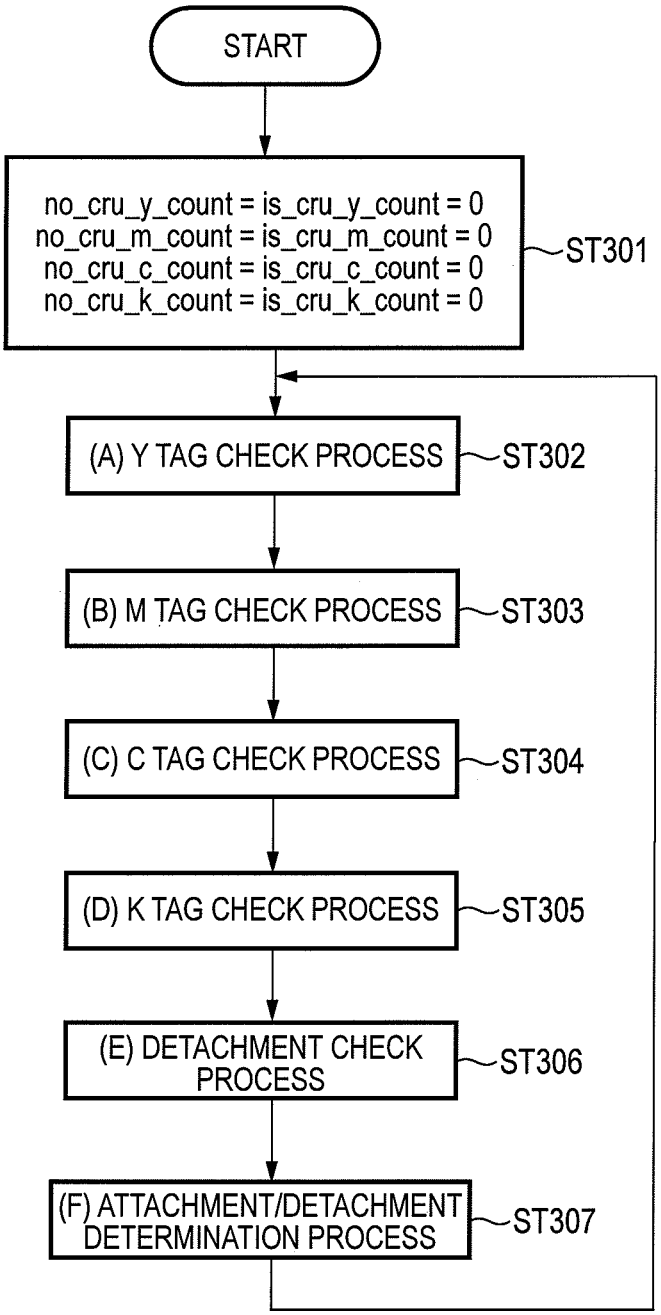
FIG. 15 is a flowchart of a process for determining whether each of the toner cartridges has been detached or newly attached.

That is, in the color printer according to the exemplary embodiment, as shown in FIG. 15, is determined whether each of the toner cartridges 60Y, 60M, 60C, and 60K has been detached or newly attached in association with opening and closure of the side cover 29 of the printer main body 1.

FIG. 15 is a flowchart of a process for determining whether each of the toner cartridges 60Y, 60M, 60C, and 60K has been detached or newly attached.

First, at step 301, the CPU 101 sets control parameters no_cru_y_count which represents the count value of the number of times of detection of the toner cartridge 60Y being absent and is_cru_y_count which represents the count value of the number of times of detection of the toner cartridge 60Y being present to "0." Likewise, the CPU 101 sets control parameters no_cru_m_count which represents the count value of the number of times of detection of the toner cartridge 60M being absent and is_cru_m_count which represents the count value of the number of times of detection of the toner cartridge 60M being present to "0," sets control parameters no_cru_c_count which represents the count value of the number of times of detection of the toner cartridge 60C being absent and is_cru_c_count which represents the count value of the number of times of detection of the toner cartridge 60C being present to "0," and sets control parameters no_cru_k_count which represents the count value of the number of times of detection of the toner cartridge 60K being absent and is_cru_k_count which represents the count value of the number of times of detection of the toner cartridge 60K being present to "0."

At step 302, the CPU 101 executes a tag check process for the toner cartridge 60Y.

Figure 16:
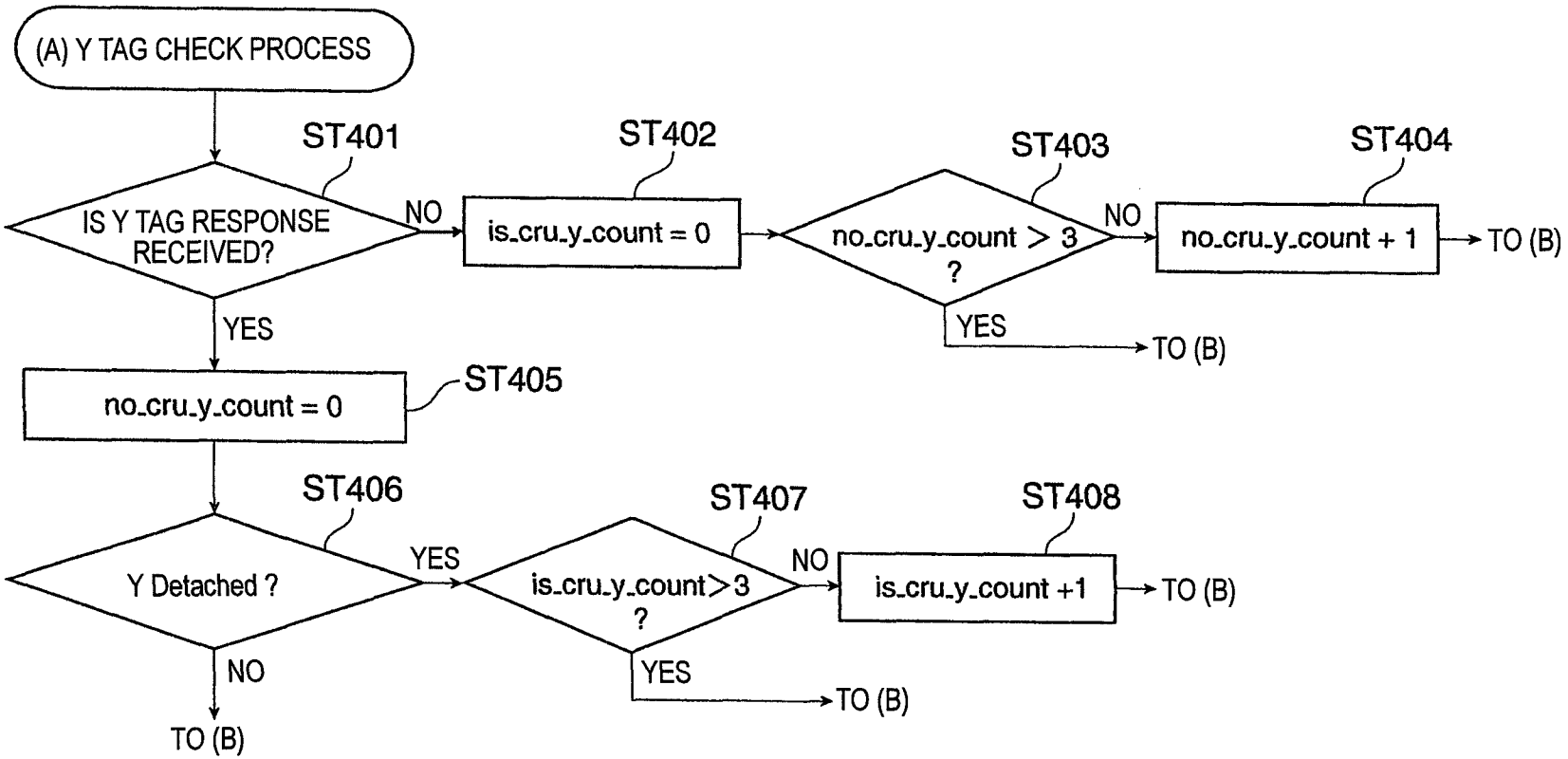
FIG. 16 is a flowchart of a Y tag check process which is part of the process of FIG. 15.

The tag check process for the toner cartridge 60Y is performed as shown in FIG. 16. At step 401, the CPU 101 determines whether or not a response is received from the tag of the toner cartridge 60Y. If no response is received from the tag of the toner cartridge 60Y (step 401: no), at step 402 the CPU 101 sets is_cru_y_count representing the count value of the number of times of detection of the toner cartridge 60Y being present to "0."

At step 403, the CPU 101 determines whether or not no_cru_y_count representing the count value of the number of times of detection of the toner cartridge 60Y being absent is larger than "3." If determining that no_cru_y_count is not larger than "3" (step 403: no), at step 404 the CPU 101 adds 1 to no_cru_y_count. Then, the CPU 101 moves to a process of FIG. 17. On the other hand, if no_cru_y_count is larger than "3" (step 403: yes), the CPU 101 moves to the process of FIG. 17 immediately.

If determining that a response is received from the tag of the toner cartridge 60Y (step 401: yes), at step 405 the CPU 101 sets no_cru_y_count to "0." At step 406, the CPU 101 determines whether the toner cartridge 60Y is detached or not. If determining that the toner cartridge 60Y is detached (step 406: yes), at step 407, the CPU 101 determines whether or not is_cru_y_count representing the count value of the number of times of detection of the toner cartridge 60Y being present is larger than "3." If determining that is_cru_y_count is not larger than "3" (step 407: no), at step 408 the CPU 101 adds 1 to is_cru_y_count. Then, the CPU 101 moves to the process of FIG. 17. On the other hand, if is_cru_y_count is larger than "3" (step 407: yes), the CPU 101 moves to the process of FIG. 17 immediately.

Figure 17:
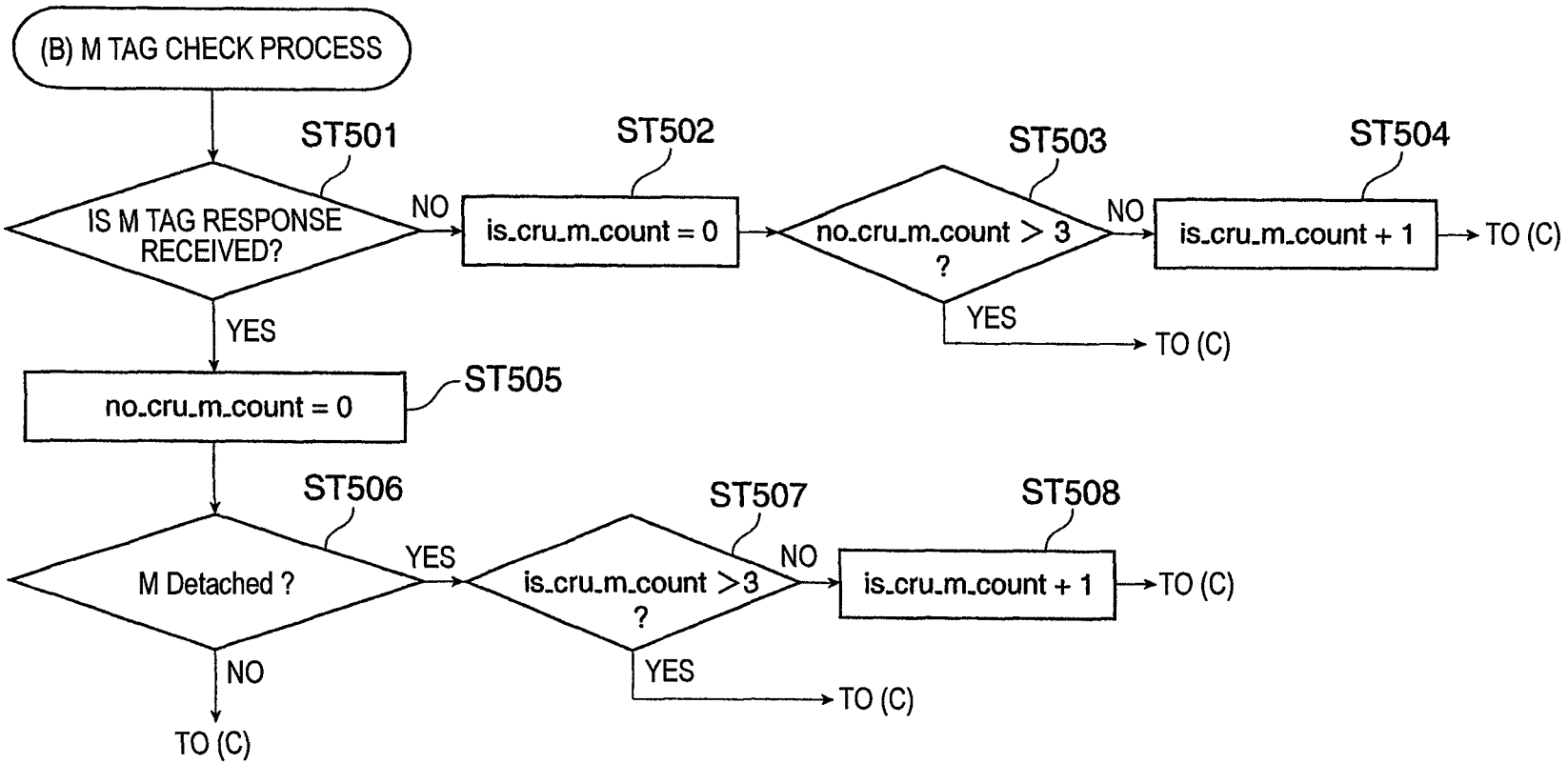
FIG. 17 is a flowchart of an M tag check process which is part of the process of FIG. 15.

The process of FIG. 17 which is directed to the toner cartridge 60M is similar to the process of FIG. 16 which is directed to the toner cartridge 60Y.

The tag check process for the toner cartridge 60M is performed as shown in FIG. 17. At step 501, the CPU 101 determines whether or not a response is received from the tag of the toner cartridge 60M. If no response is received from the tag of the toner cartridge 60M (step 501: no), at step 502 the CPU 101 sets is_cru_m_count representing the count value of the number of times of detection of the toner cartridge 60M being present to "0."

At step 503, the CPU 101 determines whether or not no_cru_m_count representing the count value of the number of times of detection of the toner cartridge 60M being absent is larger than "3." If determining that no_cru_m_count is not larger than "3" (step 503: no), at step 504 the CPU 101 adds 1 to no_cru_m_count. Then, the CPU 101 moves to a process of FIG. 18. On the other hand, if no_cru_m_count is larger than "3" (step 503: yes), the CPU 101 moves to the process of FIG. 18 immediately.

If determining that a response is received from the tag of the toner cartridge 60M (step 501: yes), at step 505 the CPU 101 sets no_cru_m_count to "0." At step 506, the CPU 101 determines whether the toner cartridge 60M is detached or not. If determining that the toner cartridge 60M is detached (step 506: yes), at step 507, the CPU 101 determines whether or not is_cru_m_count representing the count value of the number of times of detection of the toner cartridge 60M being present is larger than "3." If determining that is_cru_m_count is not larger than "3" (step 507: no), at step 508 the CPU 101 adds 1 to is_cru_m_count. Then, the CPU 101 moves to the process of FIG. 18. On the other hand, if is_cru_m_count is larger than "3" (step 507: yes), the CPU 101 moves to the process of FIG. 18 immediately.

Figure 18:
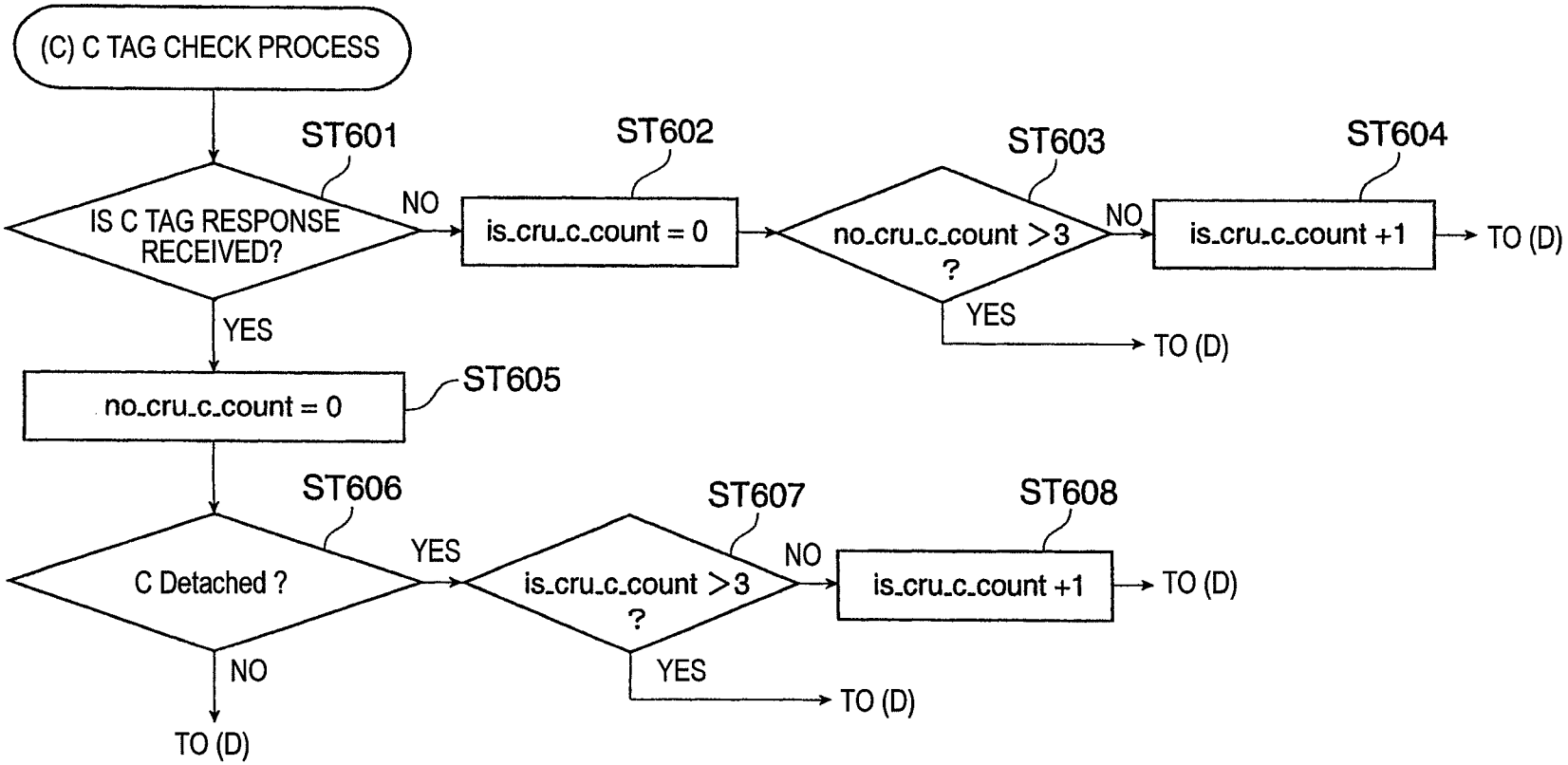
FIG. 18 is a flowchart of a C tag check process which is part of the process of FIG. 15.
Figure 19:
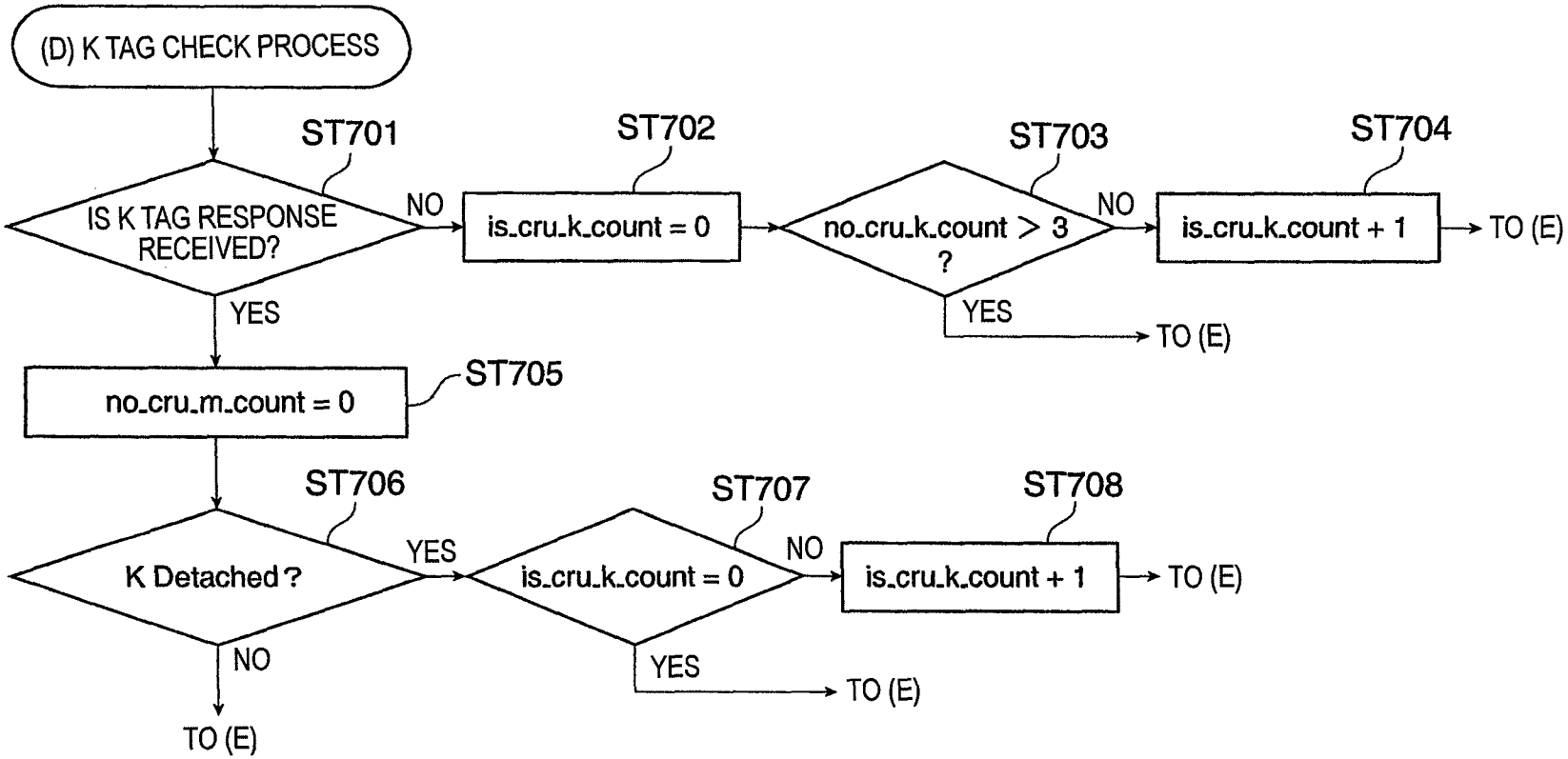
FIG. 19 is a flowchart of a K tag check process which is part of the process of FIG. 15.

The processes of FIGS. 18 and 19 which are directed to the respective toner cartridges 60C and 60K are similar to the processes of FIGS. 16 and 17 which are directed to the respective toner cartridges 60Y and 60M.

Figure 20:
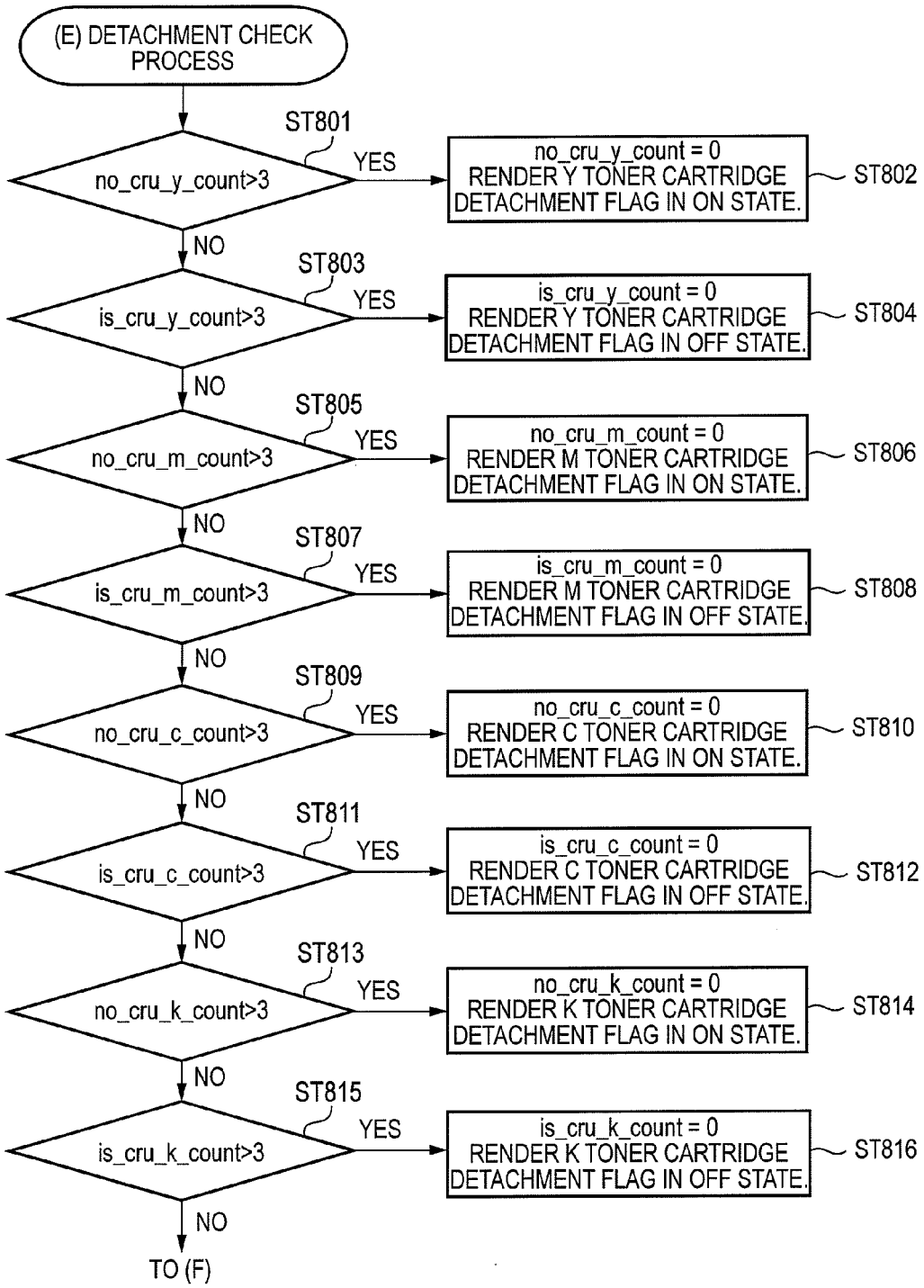
FIG. 20 is a flowchart of a detachment check process which is part of the process of FIG. 15.

FIG. 20 is a flowchart of a process for determining whether each of the toner cartridges 60Y, 60M, 60C, and 60K is detached or not.

In this process, as shown in FIG. 20, at step 801 the CPU 101 determines whether or not no_cru_y_count representing the count value of the number of times of detection of the toner cartridge 60Y being absent is larger than "3." If determining that no_cru_y_count is larger than "3" (step 801: yes), at step 802 the CPU 101 sets no_cru_y_count to "0" and renders a flag indicating whether the toner cartridge 60Y has been detached or not in an on state.

On the other hand, if determining that no_cru_y_count is not larger than "3" (step 801: no), at step 803 the CPU 101 determines whether or not is_cru_y_count representing the count value of the number of times of detection of the toner cartridge 60Y being present is larger than "3." If is_cru_y_count is larger than "3" (step 803: yes), at step 804 the CPU 101 sets is_cru_y_count to "0" and renders the flag indicating whether the toner cartridge 60Y has been detached or not in an off state.

Then, the CPU 101 executes steps 805-816 shown in FIG. 20 which are directed to the toner cartridges 60M, 60C, and 60K and are similar to steps 801-804 which are directed to the toner cartridge 60Y. Then, the CPU 101 moves to step 307 shown in FIG. 15.

Figure 21:
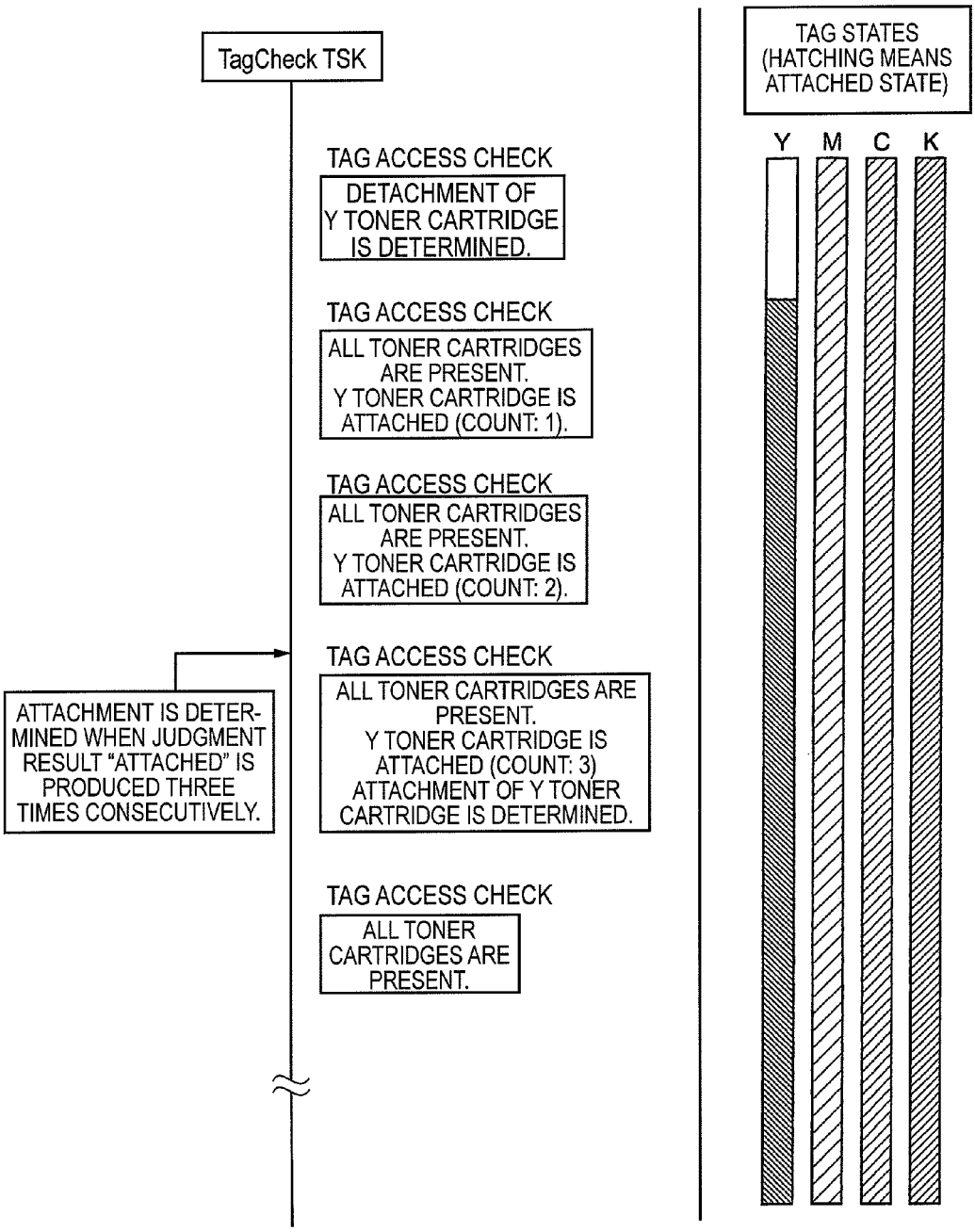
FIG. 21 shows a specific example of an attachment/detachment determination process which is part of the process of FIG. 15.
Figure 22:
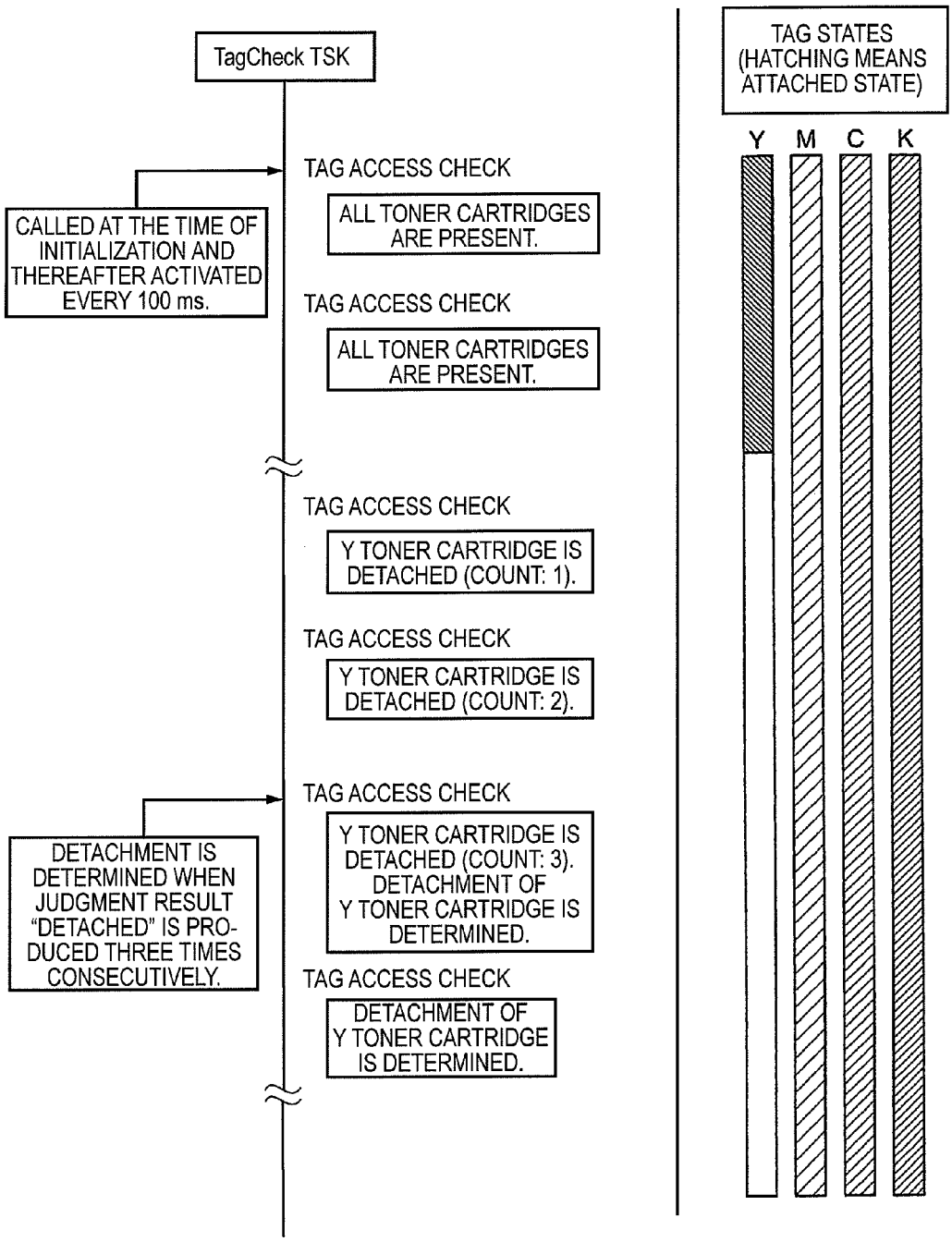
FIG. 22 shows another specific example of the attachment/detachment determination process.
Figure 23:
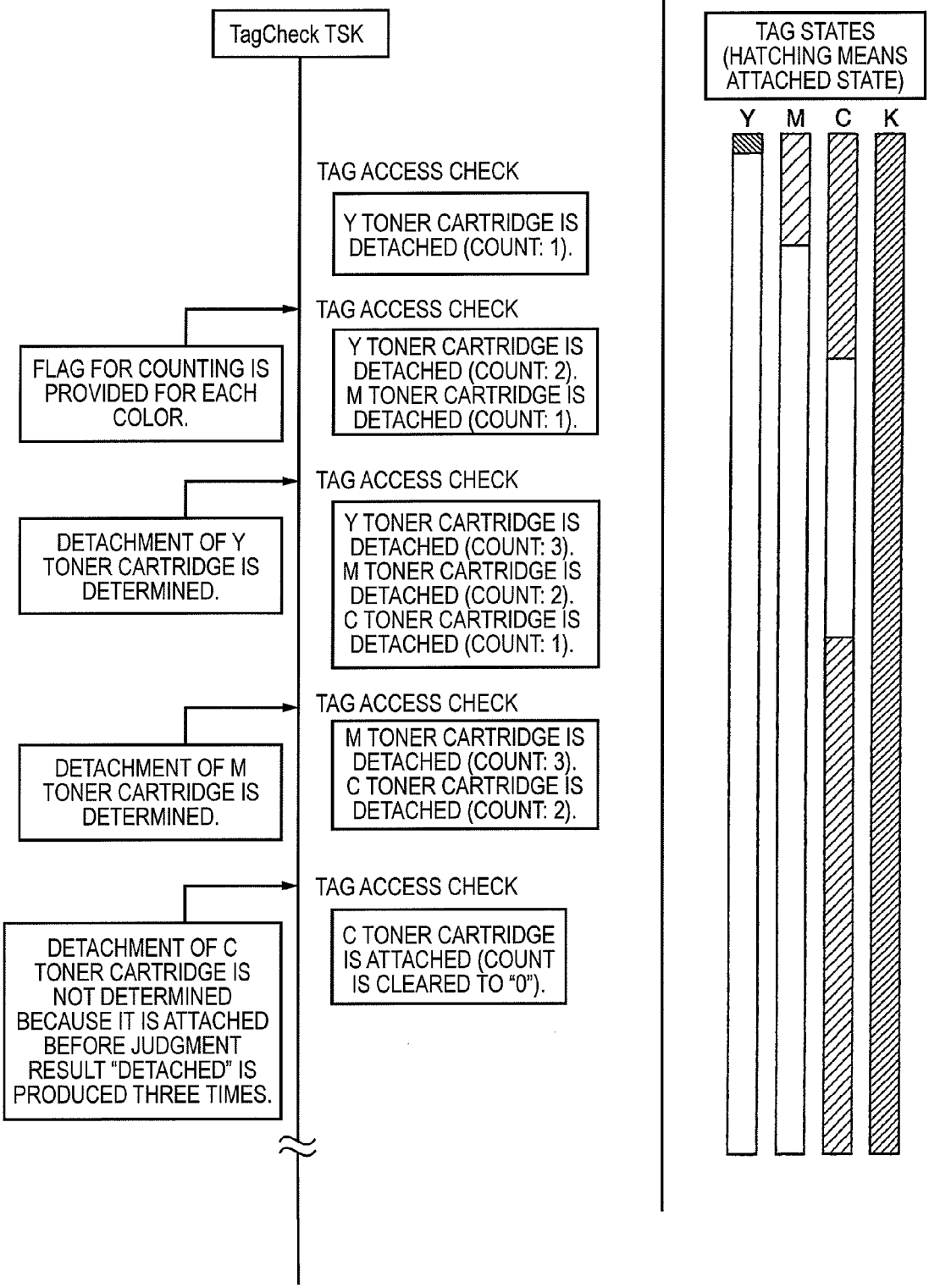
FIG. 23 shows a further specific example of the attachment/detachment determination process.
Figure 24:
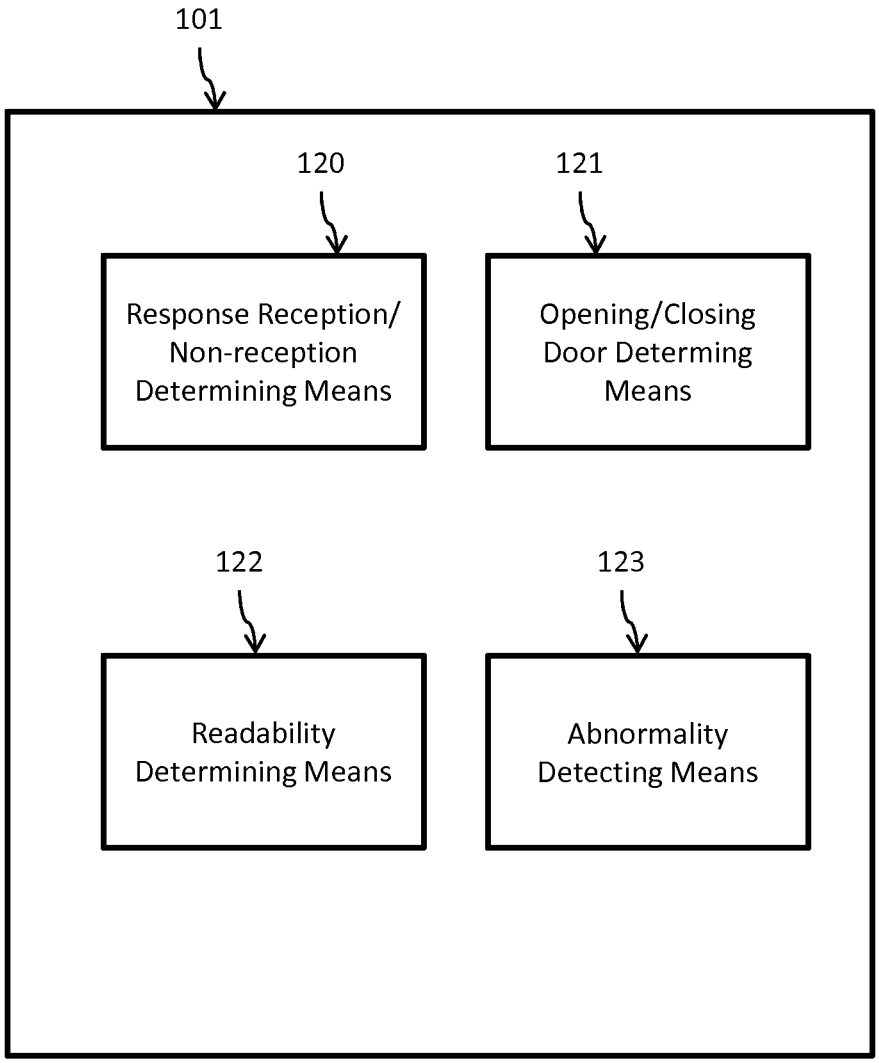
FIG. 24 shows a non-limiting functional diagram of the CPU such that the added drawing does not change the interpretation of the scope of the claims 4 and 13.

At step 307 shown in FIG. 15, as shown in FIGS. 21-23, the CPU 101 determines how many times the on state of the above-described flag indicating detachment of each of the toner cartridges 60Y, 60M, 60C, and 60K has been counted. It is determined that the toner cartridge 60Y, 60M, 60C, or 60K is detached only when the on state of the flag indicating its detachment has been counted three times.

The condition for determination of detachment of the toner cartridge 60Y, 60M, 60C, or 60K is not limited to that the on state of the flag has been counted three times. Naturally, the number of times of counting may be one, two, four, or more.

DESCRIPTION OF SYMBOLS

60Y, 60M, 60C, 60K: Toner cartridges (members to be replaced); 61: Storage means; 101: CPU (response reception/non-reception determining means).

The foregoing description of the exemplary embodiment of the present invention has been provided for the purpose of illustration and description. It is not intended to be exhaustive or to limit the invention to the precise forms disclosed. Obviously, many modifications and various will be apparent to practitioners skilled in the art. The embodiments were chosen and described in order to best explain the principles of the invention and its practical application, thereby enabling other skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a replaceable member that is removable from the image forming apparatus in an open state of a door, the replaceable member having a storage portion storing information;

a first determination unit that determines whether or not a response from the storage portion exists;

a second determination unit that determines the image forming apparatus is in the open state, or a removed state where the replaceable member is removed from the image forming apparatus, when the first determination unit determines the response does not exist a predetermined number of times; and a control unit that controls image forming operation of the image forming apparatus, wherein when an image forming job is being executed by keeping printing on a sheet with toners from the replaceable member while the second determination unit determines the replaceable member being used for printing is removed from the image forming apparatus, the control unit continues the image forming job without stopping printing on the sheet wherein the control unit continues the image forming job without stopping printing on the sheet when the amount of the toners remaining in the replaceable member's corresponding developing device is sufficient for the image forming job or information of the storage portion of the removed replaceable member is not necessary in the image forming job.

2. The image forming apparatus according to claim 1, further comprising:

a third determination unit that determines whether at least reading of the information stored in the storage unit is possible or not; and a fourth determination unit that determines the replaceable member has an abnormality when the third determination unit determines the reading of the information is not possible in a predetermined number of times.

3. The image forming apparatus according to claim 2, further comprising a selecting unit that selects between continuation and non-continuation of the image forming operation which is ongoing when the second determination unit determines the image forming apparatus is in the removed state during execution of the image formation operation.

4. The image forming apparatus according to claim 1, further comprising a selecting unit that selects between continuation and non-continuation of the image forming operation which is ongoing when the second determination unit determines the image forming apparatus is in the removed state during execution of the image formation operation.

5. An image forming apparatus comprising:

a replaceable member that is removable from the image forming apparatus in an open state of a door, the replaceable member having a storage portion storing information;

a first determination unit that determines whether or not a response from the storage portion exists;

a second determination unit that determines the image forming apparatus is in the open state, or a removed state where the replaceable member is removed from the image forming apparatus, when the first determination unit determines the response does not exist a predetermined number of times, and a selecting unit that selects between continuation and non-continuation of an image forming job which is being executed while the second determination unit determines the replaceable member is removed from the image forming apparatus, wherein when an image forming job is being executed by keeping printing on a sheet with toners from the replaceable member while the second determination unit determines the replaceable member being used for printing is removed from the image forming apparatus, a control unit continues the image forming job without stopping printing on the sheet wherein the control unit continues the image forming job without stopping printing on the sheet when the amount of the toners remaining in the replaceable member's corresponding developing device is sufficient for the image forming job or information of the storage portion of the removed replaceable member is not necessary in the image forming job.

6. The image forming apparatus according to claim 5, further comprising:

a third determination unit that determines whether at least reading of the information stored in the storage unit is possible or not; and a fourth determination unit that determines the replaceable member has an abnormality when the third determination unit determines the reading of the information is not possible in a predetermined number of times.

* * * * *